US007578571B2

(12) United States Patent
Nakano et al.

(10) Patent No.: US 7,578,571 B2
(45) Date of Patent: Aug. 25, 2009

(54) CORRECTION VALUE DETERMINING METHOD, CORRECTION VALUE DETERMINING APPARATUS, AND STORAGE MEDIUM HAVING PROGRAM STORED THEREON

(75) Inventors: Tatsuya Nakano, Nagano-ken (JP); Masahiko Yoshida, Shiojiri (JP); Bunji Ishimoto, Nagano-ken (JP); Toru Miyamoto, Shiojiri (JP); Hirokazu Nunokawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 146 days.

(21) Appl. No.: 11/866,134

(22) Filed: Oct. 2, 2007

(65) Prior Publication Data

US 2008/0106031 A1 May 8, 2008

(30) Foreign Application Priority Data

Oct. 2, 2006 (JP) ..... 2006-270905

(51) Int. Cl.
*B41J 29/393* (2006.01)

(52) U.S. Cl. ..... 347/19

(58) Field of Classification Search ..... 347/12, 347/14, 19, 41, 43, 101, 104, 105; 358/504
See application file for complete search history.

(56) References Cited

U.S. PATENT DOCUMENTS 6,908,173 B2 * 6/2005 Otsuki et al. ..... 347/19
6,938,977 B2 * 9/2005 Corbin et al. ..... 347/19

FOREIGN PATENT DOCUMENTS

JP 05096796 A 4/1993
JP 2003011345 A 1/2003

* cited by examiner

*Primary Examiner*—Lamson D Nguyen
(74) *Attorney, Agent, or Firm*—Sughrue Mion, PLLC

(57) ABSTRACT

A correction value determining method of the present invention includes: causing a head to record a first pattern for confirming a transport amount of a medium, while transporting the medium in a transport direction relative to the head in accordance with a target transport amount, obtaining a first correction value that is associated with a relative position of the head and the medium based on the first pattern, the first correction value being a correction value for correcting the target transport amount during transport of the medium, causing the head to record a second pattern for confirming the transport amount of the medium, by transporting the medium while correcting the target transport amount using the first correction value associated with the relative position, obtaining a second correction value that is associated with the relative position of the head and the medium based on the second pattern, the second correction value being a correction value for correcting the target transport amount during transport of the medium, and determining a correction value of the target transport amount by making a use of the first correction value and the second correction value associated with the relative position when the medium reaches a roller provided on the downstream side of the head in the transport direction different from a use of the first correction value and the second correction value associated with the relative position at times other than when the medium reaches the roller.

9 Claims, 27 Drawing Sheets

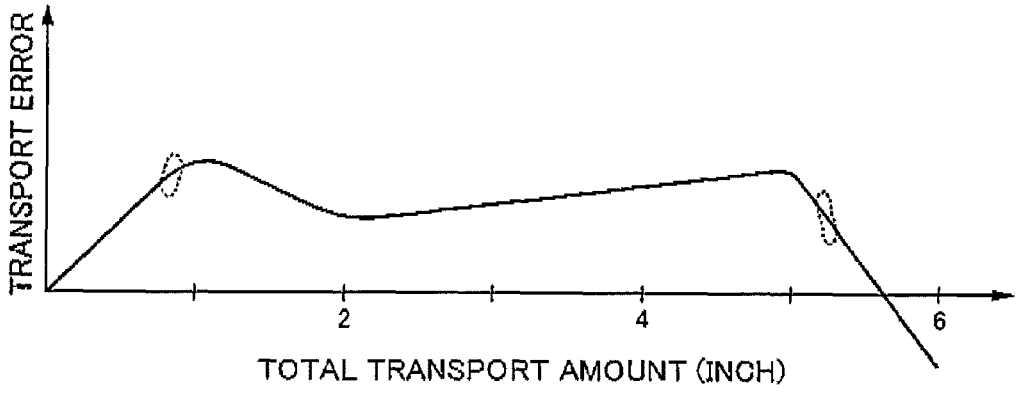
FIG. 7
FIG. 8A
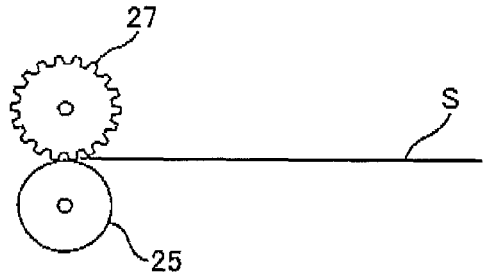
FIG. 8B
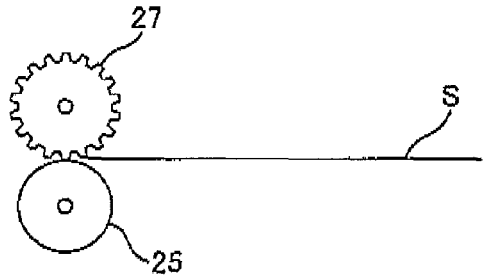

| CORRECTION VALUE (FIRST) | BORDER POSITION INFORMATION |
|---|---|
| Ca(1) | THEORETICAL POSITION CORRESPONDING TO L2 |
| Ca(2) | THEORETICAL POSITION CORRESPONDING TO L3 |
| Ca(3) | THEORETICAL POSITION CORRESPONDING TO L4 |
| ⋮ | ⋮ |
| Ca(20) | THEORETICAL POSITION CORRESPONDING TO L21 |
| Ca(21) | THEORETICAL POSITION CORRESPONDING TO L22 |

| CORRECTION VALUE (SECOND) | BORDER POSITION INFORMATION |
|---|---|
| Ca'(1) | THEORETICAL POSITION CORRESPONDING TO L2 |
| Ca'(2) | THEORETICAL POSITION CORRESPONDING TO L3 |
| Ca'(3) | THEORETICAL POSITION CORRESPONDING TO L4 |
| ⋮ | ⋮ |
| Ca'(20) | THEORETICAL POSITION CORRESPONDING TO L21 |
| Ca'(21) | THEORETICAL POSITION CORRESPONDING TO L22 |

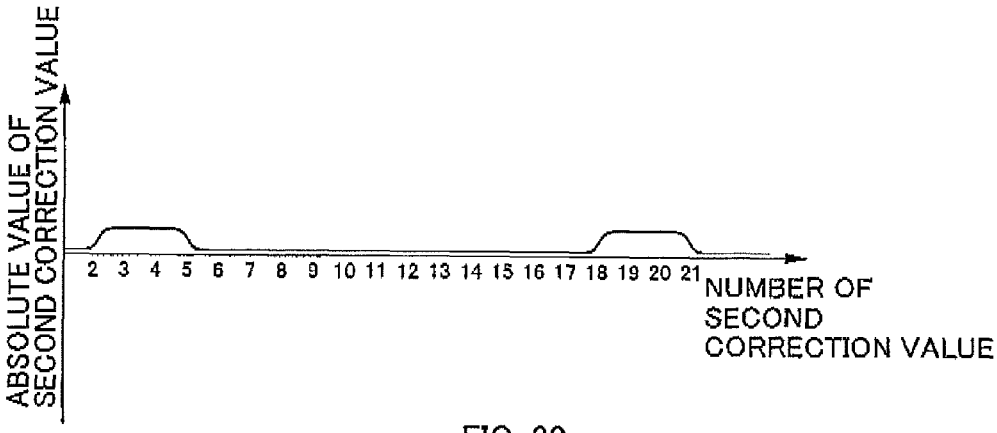

FIG. 30

| CORRECTION VALUE (FINAL) | BORDER POSITION INFORMATION |
|---|---|
| $Ca''(1)=Ca(1)+Ca'(1)$ | THEORETICAL POSITION CORRESPONDING TO L2 |
| $Ca''(2)=Ca(2)+\frac{Ca'(2)}{2}$ | THEORETICAL POSITION CORRESPONDING TO L3 |
| $Ca''(3)=Ca(3)+\frac{Ca'(3)}{2}$ | THEORETICAL POSITION CORRESPONDING TO L4 |
| $Ca''(4)=Ca(4)+\frac{Ca'(4)}{2}$ | THEORETICAL POSITION CORRESPONDING TO L5 |
| $Ca''(5)=Ca(5)+\frac{Ca'(5)}{2}$ | THEORETICAL POSITION CORRESPONDING TO L6 |
| $Ca''(6)=Ca(6)+Ca'(6)$ | THEORETICAL POSITION CORRESPONDING TO L7 |
| ⋮ | ⋮ |
| $Ca''(18)=Ca(18)+\frac{Ca'(18)}{2}$ | THEORETICAL POSITION CORRESPONDING TO L19 |
| $Ca''(19)=Ca(19)+\frac{Ca'(19)}{2}$ | THEORETICAL POSITION CORRESPONDING TO L20 |
| $Ca''(20)=Ca(20)+\frac{Ca'(20)}{2}$ | THEORETICAL POSITION CORRESPONDING TO L21 |
| $Ca''(21)=Ca(21)+\frac{Ca'(21)}{2}$ | THEORETICAL POSITION CORRESPONDING TO L22 |

FIG. 31

CORRECTION VALUE DETERMINING METHOD, CORRECTION VALUE DETERMINING APPARATUS, AND STORAGE MEDIUM HAVING PROGRAM STORED THEREON

CROSS-REFERENCE TO RELATED APPLICATIONS

The present application claims priority of Japanese Patent Application No. 2006-270905 filed on Oct. 2, 2006, the entire disclosure of which is herein incorporated by reference.

BACKGROUND

1. Technical Field

The present invention relates to correction value determining methods, correction value determining apparatuses, and storage media having a program stored thereon.

2. Related Art

Inkjet printers are known as recording apparatuses in which a medium (such as paper or cloth for example) is transported in a transport direction and recording is carried out on the medium with a head. When a transport error occurs while transporting the medium in a recording apparatus such as this, the head cannot perform recording at a correct position on the medium. In particular, with inkjet printers, when ink droplets do not land in the correct positions on the medium, there is a risk that white streaks or black streaks will occur in the printed image and the picture quality will deteriorate.

Accordingly, methods have been proposed for correcting transport amounts of the medium. For example, JP-A-5-96796 and JP-A-2003-11345 propose that a test pattern is printed, then the test pattern is read and correction values are calculated based on the reading results such that when an image is to be recorded, the transport amounts are corrected based on the correction values.

In this regard, in correcting the transport amount for the respective positions on the medium, it is necessary to obtain correction values corresponding thereto. While a medium is actually transported in obtaining such correction values, the medium includes a portion that is steadily transported and a portion that is not steadily transported. In the portion that is steadily transported, a constant amount of transport error occurs in every transport, while the amount of transport error is not constant in the portion that is not steadily transported. Accordingly, in some cases, more appropriate correction values may be obtained by using different methods in obtaining correction values applied for the portion that is steadily transported and those applied for the portion that is not steadily transported.

SUMMARY

The invention has been achieved to address the above-described circumstances, and has an advantage of obtaining appropriate correction values corresponding to the portion that is steadily transported and those corresponding to the portion that is not steadily transported, by using different methods in obtaining the correction values corresponding to the respective portions.

A primary aspect of the invention for achieving the above-described advantage is:

a correction value determining method including:

causing a head to record a first pattern for confirming a transport amount of a medium, while transporting the medium in a transport direction relative to the head in accordance with a target transport amount;

obtaining a first correction value that is associated with a relative position of the head and the medium based on the first pattern, the first correction value being a correction value for correcting the target transport amount during transport of the medium;

causing the head to record a second pattern for confirming the transport amount of the medium, by transporting the medium while correcting the target transport amount using the first correction value associated with the relative position;

obtaining a second correction value that is associated with the relative position of the head and the medium based on the second pattern, the second correction value being a correction value for correcting the target transport amount during transport of the medium; and determining a correction value of the target transport amount by making a use of the first correction value and the second correction value associated with the relative position when the medium reaches a roller provided on the downstream side of the head in the transport direction different from a use of the first correction value and the second correction value associated with the relative position at times other than when the medium reaches the roller.

Other features of the invention other than the above will become clear by reading the description of the present specification with reference to the accompanying drawings.

BRIEF DESCRIPTION OF THE DRAWINGS

FIG. 7 is a diagram showing transport error of paper S for a portion that is steadily transported during transport and a portion that is not steadily transported during transport;

FIG. 8A is a diagram showing a state A when the paper reaches a toothed roller;

FIG. 8B is a diagram showing a state B when the paper reaches a toothed roller;

FIG. 30 is a diagram showing absolute values of the second correction values corresponding to the relative position of paper and a head; and FIG. 31 is an explanatory diagram of a table of correction values (final) obtained by a final correction value determining process.

DESCRIPTION OF EXEMPLARY EMBODIMENTS

Figure 1:
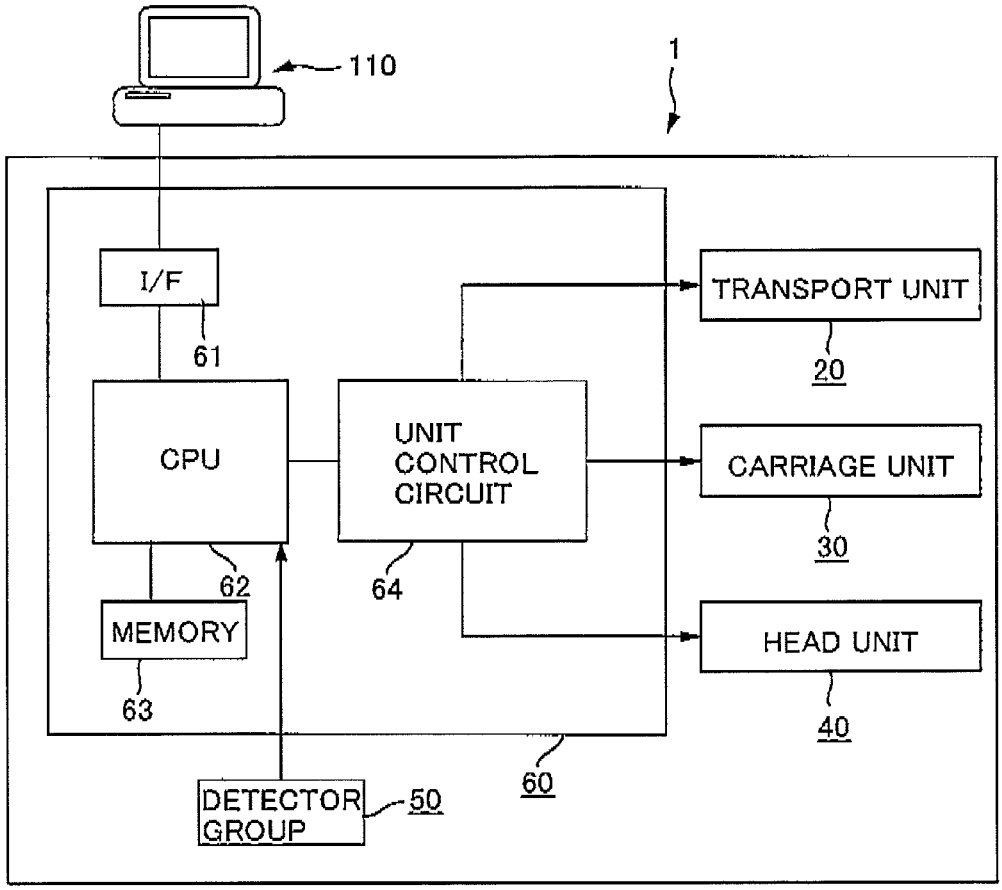
FIG. 1 is a block diagram of an overall configuration of a printer 1.

At least the following matters will be made clear by reading the description of the present specification with reference to the accompanying drawings.

A correction value determining method including:

causing a head to record a first pattern for confirming a transport amount of a medium, while transporting the medium in a transport direction relative to the head in accordance with a target transport amount;

obtaining a first correction value that is associated with a relative position of the head and the medium based on the first pattern, the first correction value being a correction value for correcting the target transport amount during transport of the medium;

causing the head to record a second pattern for confirming the transport amount of the medium, by transporting the medium while correcting the target transport amount using the first correction value associated with the relative position;

obtaining a second correction value that is associated with the relative position of the head and the medium based on the second pattern, the second correction value being a correction value for correcting the target transport amount during transport of the medium; and determining a correction value of the target transport amount by making a use of the first correction value and the second correction value associated with the relative position when the medium reaches a roller provided on the downstream side of the head in the transport direction different from a use of the first correction value and the second correction value associated with the relative position at times other than when the medium reaches the roller.

In this manner, it is possible to obtain appropriate correction values applied to the portion of the medium that is steadily transported and those applied to the portion that is not steadily transported, by using different methods in obtaining the correction values corresponding to the respective portions.

In such a correction value determining method, it is preferable that determining the correction value for the target transport amount includes using a sum of the first correction value and the second correction value as the correction value for the target transport amount associated with the relative position at times other than when the medium reaches the roller. Also, it is preferable that determining the correction value for the target transport amount includes using a value between the first correction value and the sum of the first and second correction values as the correction value for the target transport amount associated with the relative position when the medium reaches the roller. Also, it is preferable that determining the correction value for the target transport amount includes using a median value of the first correction value and the sum of the first and second correction values, as the correction value for the target transport amount associated with the relative position when the medium reaches the roller. Also, it is preferable that determining the correction value for the target transport amount further includes determining the correction value of the target transport amount by making a use of the first correction value and the second correction value associated with the relative position when the medium ceases to be secured by a roller provided on the upstream side of the head in the transport direction different from a use of the first correction value and the second correction value associated with the relative position at times other than when the medium ceases to be secured by the roller provided on the upstream side.

In addition, it is preferable that the relative position when the medium ceases to be secured by the roller provided on the upstream side and the relative position when the medium reaches the roller provided on the downstream side are determined in advance depending on the positional relationship of the roller provided on the upstream side and the roller provided on the downstream side. Also, it is preferable that the first correction value and the second correction value associated with the relative position are used in the same manner when the medium ceases to be secured by the roller provided on the upstream side and when the medium reaches the roller provided on the downstream side.

In this manner, it is possible to obtain appropriate correction values applied to the portion of the medium that is steadily transported and those applied to the portion that is not steadily transported, by using different methods in obtaining the correction values corresponding to the respective portions.

A correction value determining apparatus, including;

(A) a memory that stores a first correction value and a second correction value, the first correction value being associated with a relative position of a head and a medium, and used to correct a target transport amount during transport of the medium based on a first pattern for confirming a transport amount of the medium, the second correction value being associated with the relative position of the head and the medium based on a second pattern for confirming the transport amount of the medium, the second pattern being a pattern recorded while the medium is transported based on the first correction value, (B) a calculating section that determines a correction value of the target transport amount, by making a use of the first correction value and the second correction value associated with the relative position when the medium reaches a roller provided on the downstream side of the head in the transport direction different from a use of the first correction value and the second correction value associated with the relative position at times other than when the medium reaches the roller.

In this manner, it is possible to obtain appropriate correction values applied to the portion that is steadily transported and those applied to the portion that is not steadily transported, by using different methods in obtaining the correction values corresponding to the respective portions.

A storage medium with a program stored thereon, the program including:

a code for causing a head to record a first pattern for confirming a transport amount of a medium, while transporting the medium in a transport direction relative to the head in accordance with a target transport amount;

a code for obtaining a first correction value that is associated with a relative position of the head and the medium based on the first pattern, the first correction value being a correction value for correcting the target transport amount during transport of the medium;

a code for causing the head to record a second pattern for confirming the transport amount of the medium, by transporting the medium while correcting the target transport amount using the first correction value associated with the relative position;

a code for obtaining a second correction value that is associated with the relative position of the head and the medium based on the second pattern, the second correction value being a correction value for correcting the target transport amount during transport of the medium; and a code for correcting the target transport amount by a use of the first correction value and the second correction value associated with the relative position when the medium reaches a roller provided on the downstream side of the head in the transport direction that is different from a use of the first correction value and the second correction value associated with the relative position at times other than when the medium reaches the roller.

In this manner, it is possible to obtain appropriate correction values applied to the portion that is steadily transported and those applied to the portion that is not steadily transported, by using different methods in obtaining the correction values corresponding to the respective portions.

Configuration of Printer

Regarding Configuration of Inkjet Printer

Figure 2A:
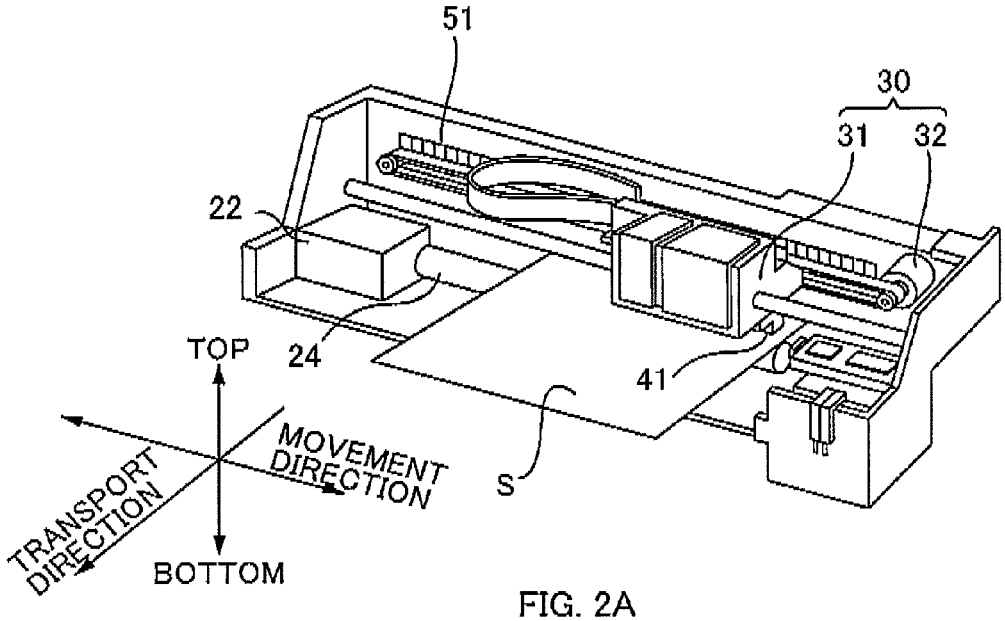
FIG. 2A is a schematic view of the overall configuration of the printer 1.
Figure 2B:
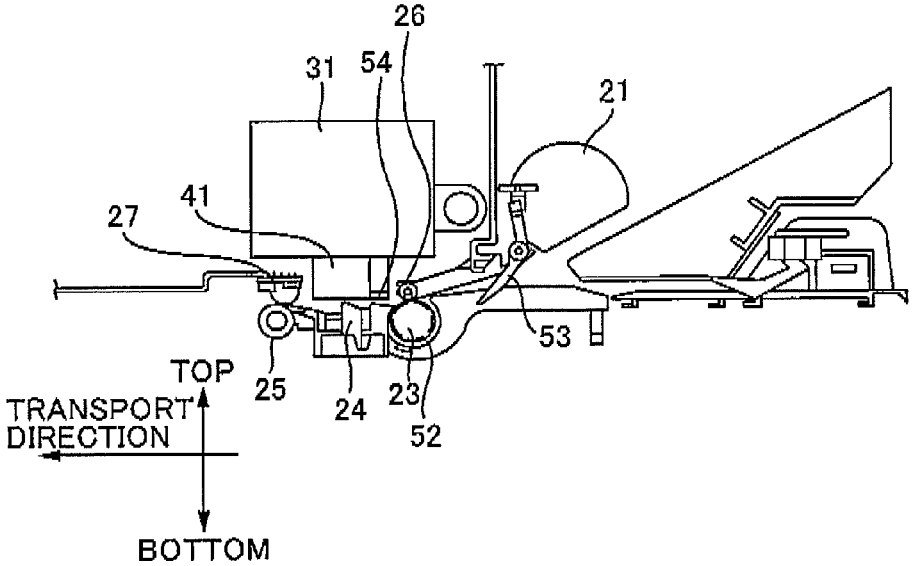
FIG. 2B is a lateral cross-sectional view of the overall configuration of the printer 1.

FIG. 1 is a block diagram of an overall configuration of a printer 1. FIG. 2A is a schematic view of the overall configuration of the printer 1. FIG. 2B is a lateral cross-sectional view of the overall configuration of the printer 1. Hereinafter, the basic configuration of the printer is described.

The printer 1 includes a transport unit 20, a carriage unit 30, a head unit 40, a detector group 50, and a controller 60. The printer 1, upon having received print data from a computer 110, which is an external device, controls various units (the transport unit 20, the carriage unit 30, and the head unit 40) using the controller 60. The controller 60 controls the units based on the print data received from the computer 110, to form an image on paper. The detector group 50 monitors the conditions within the printer 1, and outputs the detection results to the controller 60. The controller 60 controls the units based on the detection results output from the detector group 50.

The transport unit 20 is for transporting a medium (for example, such as paper S) in a predetermined direction (hereinafter referred to as transport direction). The transport unit 20 includes a paper-feed roller 21, a transport motor 22 (hereinafter also referred to as PF motor), a transport roller 23, a platen 24, and discharge rollers 25. The paper-feed roller 21 is a roller for feeding paper that has been inserted into a paper insert opening into the printer. The transport roller 23 is a roller for transporting the paper S that has been fed by the paper-feed roller 21 up to a printable region, and is driven by the transport motor 22. The platen 24 supports the paper S that is being printed. The discharge rollers 25 are rollers for discharging the paper S out of the printer, and are provided on the downstream side, with respect to the transport direction, of the printable region. The discharge rollers 25 are rotated in synchronization with the transport roller 23.

Figure 4:
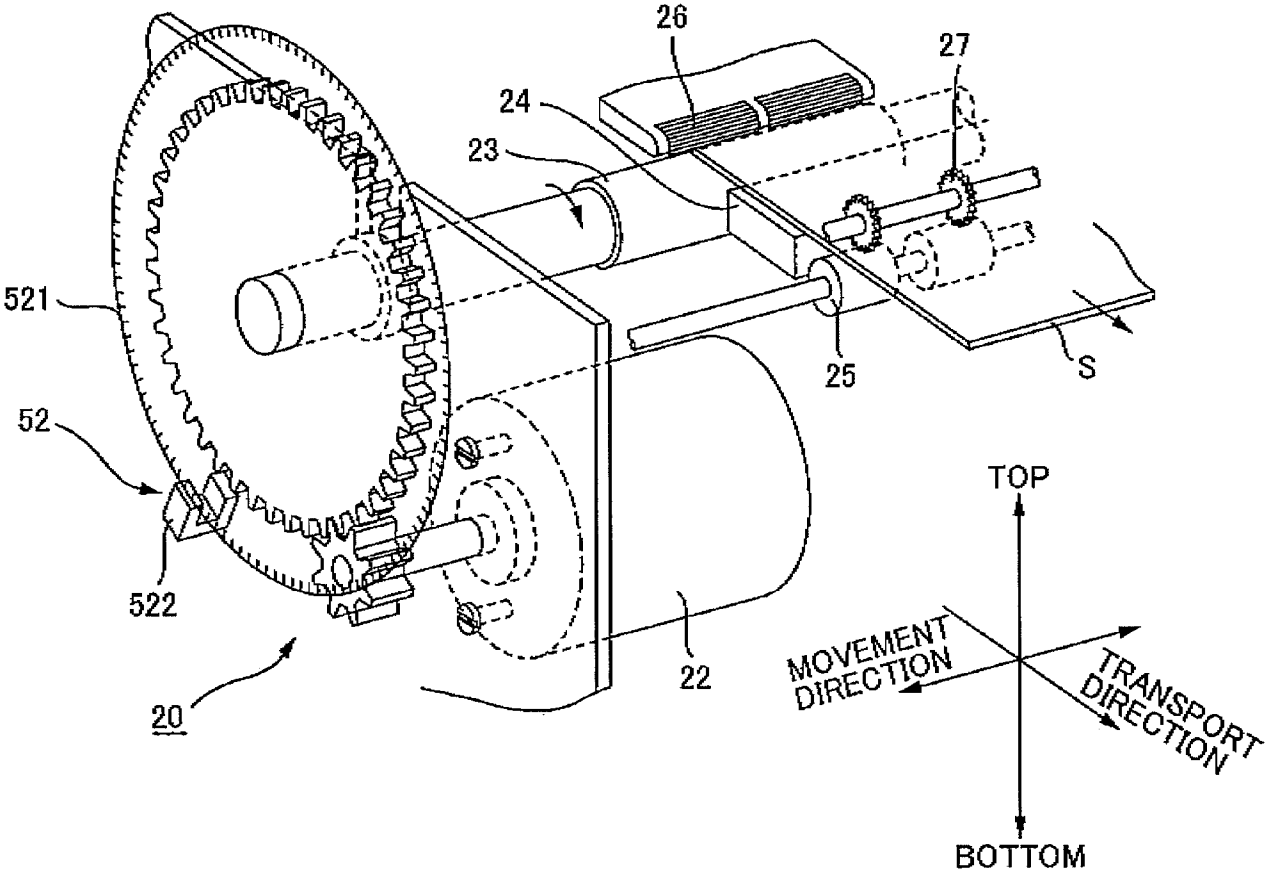
FIG. 4 is an explanatory diagram of a configuration of a transport unit 20.

It should be noted that when the transport roller 23 transports the paper S, the paper S is sandwiched between the transport roller 23 and driven rollers 26. In this way, the posture of the paper S is kept stable. On the other hand, when the discharge rollers 25 transport the paper S, the paper S is sandwiched between the discharge rollers 25 and driven rollers 27. It should be noted that here the driven rollers 27 are referred to as "toothed rollers" for the sake of convenience. The toothed rollers 27 are configured such that concave and convex portions are arranged alternately like saw teeth in the portion that contacts paper, and is furthermore configured to be thin (FIG. 4). In this manner, the contact area to the printing surface is kept small in order not to soil the paper with ink transferred to the roller.

The carriage unit 30 is for making a head move (also referred to as "scan") in a predetermined direction (hereinafter, referred to as a "movement direction"). The carriage unit 30 includes a carriage 31 and a carriage motor 32 (also referred to as a "CR motor"). The carriage 31 can move in a reciprocating manner along the movement direction, and is driven by the carriage motor 32. Furthermore, the carriage 31 detachably retains an ink cartridge that contains ink.

The head unit 40 is for ejecting ink onto paper. The head unit 40 is provided with a head 41 including a plurality of nozzles. The head 41 is provided on the carriage 31 so that when the carriage 31 moves in the movement direction, the head 41 also moves in the movement direction. Then, dot lines (raster lines) are formed on the paper in the movement direction as a result of the head 41 intermittently ejecting ink while moving in the movement direction.

The detector group 50 includes a linear encoder 51, a rotary encoder 52, a paper detection sensor 53, and an optical sensor 54, for example. The linear encoder 51 is for detecting the position of the carriage 31 in the movement direction. The rotary encoder 52 is for detecting the amount of rotation of the transport roller 23. The paper detection sensor 53 detects the position of the front end of the paper that is being fed. The optical sensor 54 detects whether or not the paper is present by a light-emitting section and a light-receiving section provided in the carriage 31. The optical sensor 54 can also detect the width of the paper by detecting the position of the end portions of the paper while being moved by the carriage 31. Depending on the circumstances, the optical sensor 54 can also detect the front end of the paper (the end portion on the downstream side with respect to the transport direction; also called the upper end) and the rear end of the paper (the end portion on the upstream side with respect to the transport direction; also called the lower end).

The controller 60 is a control unit (controller) for controlling the printer. The controller 60 includes an interface section 61, a CPU 62, a memory 63, and a unit control circuit 64. The interface section 61 exchanges data between the computer 110, which is an external device, and the printer 1. The CPU 62 is a computer processing device for carrying out overall control of the printer. The memory 63 is for reserving a working region and a region for storing the programs for the CPU 62, for instance, and has a memory device such as a RAM or an EEPROM. The CPU 62 controls each unit via the unit control circuit 64 according to a program stored in the memory 63.

Regarding the Nozzles

Figure 3:
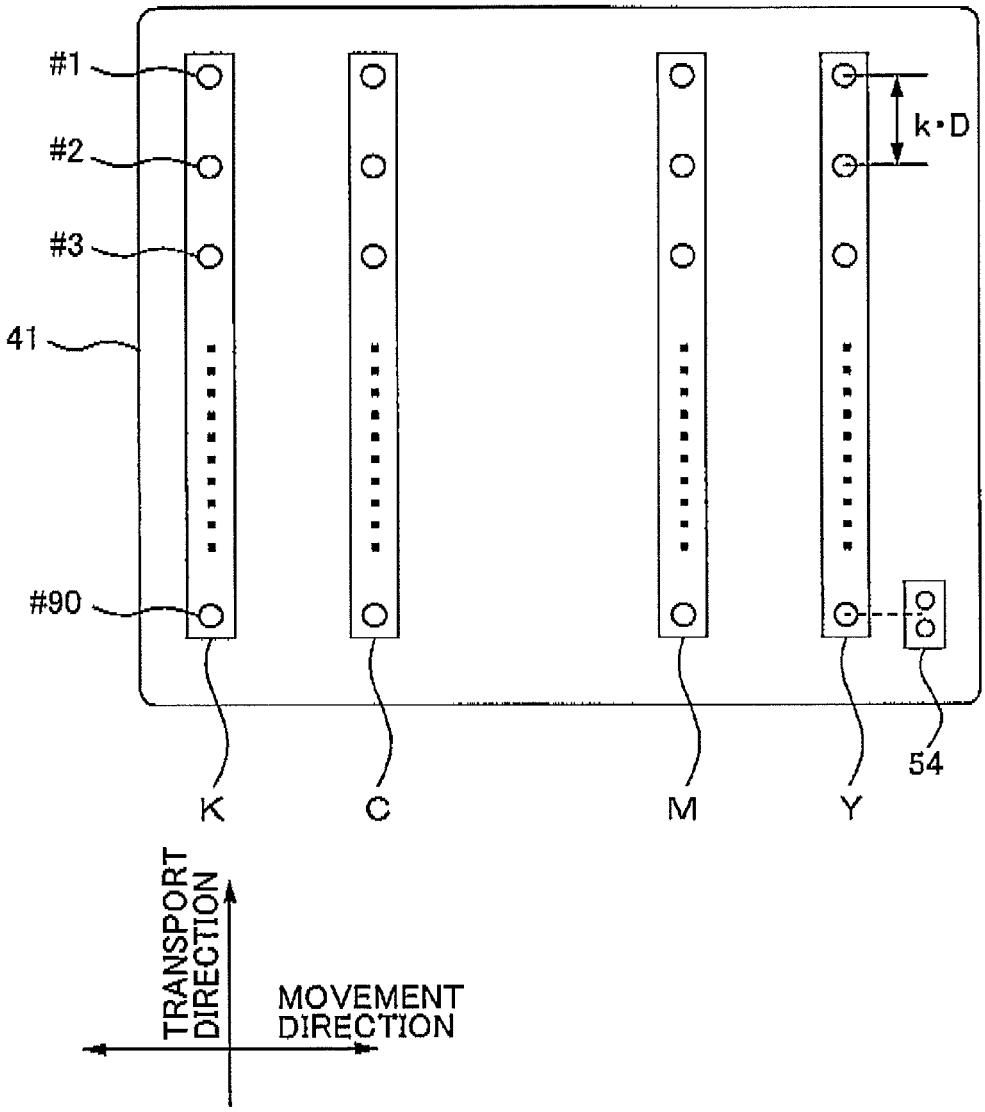
FIG. 3 is an explanatory diagram showing an arrangement of nozzles.

FIG. 3 is an explanatory diagram showing the arrangement of the nozzles in the lower side of the head 41. A black ink nozzle group K, a cyan ink nozzle group C, a magenta ink nozzle group M, and a yellow ink nozzle group Y are formed in the lower side of the head 41. Each nozzle group is provided with 90 nozzles that are ejection openings for ejecting inks of various colors.

The plurality of nozzles of the nozzle groups are arranged in rows at a constant spacing (nozzle pitch: k·D) in the transport direction. Here D is the minimum dot pitch in the transport direction (that is, the spacing at the maximum resolution of dots formed on the paper S). Also, k is an integer of 1 or more. For example, if the nozzle pitch is 90 dpi (1/90 inch) and the dot pitch in the transport direction is 720 dpi (1/720 inch), then k=8.

The nozzles of each of the nozzle groups are assigned a number (#1 through #90) that becomes smaller for nozzles further downstream. That is, the nozzle #1 is positioned further downstream in the transport direction than the nozzle #90. Also, the optical sensor 54 described above is provided substantially to the same position as the nozzle #90, which is on the side furthest upstream, as regards the position in the paper transport direction.

Each nozzle is provided with an ink charter (not shown) and a piezo element. Driving the piezo element causes the ink chamber to expand and contract, thereby ejecting an ink droplet from the nozzle.

Transport Error

Regarding Paper Transport

FIG. 4 is an explanatory diagram of a configuration of the transport unit 20.

The transport unit 20 drives the transport motor 22 by a predetermined drive amount in accordance with a transport command from the controller 60. The transport motor 22 generates a drive force in the rotation direction that corresponds to the drive amount that has been commanded. The transport motor 22 then rotates the transport roller 23 using this drive force. That is, when the transport motor 22 generates a predetermined drive amount, the transport roller 23 is rotated by a predetermined rotation amount. When the transport roller 23 is rotated by the predetermined rotation amount, the paper is transported by a predetermined transport amount.

The amount that the paper is transported is determined according to the rotation amount of the transport roller 23. In the present embodiment, when the transport roller 23 performs a full rotation, the paper is transported by one inch (that is, the circumference of the transport roller 23 is one inch). Thus, when the transport roller 23 performs a ¼ rotation, the paper is transported by ¼ inch.

Consequently, if the rotation amount of the transport roller 23 can be detected, it is also possible to detect the transport amount of the paper. Accordingly, the rotary encoder 52 is provided in order to detect the rotation amount of the transport roller 23.

The rotary encoder 52 has a scale 521 and a detection section 522. The scale 521 has numerous slits provided at a predetermined spacing. The scale 521 is provided on the transport roller 23. That is, the scale 521 rotates together with the transport roller 23 when the transport roller 23 is rotated. Then, when the transport roller 23 rotates, each slit in the scale 521 successively passes through the detection section 522. The detection section 522 is provided in opposition to the scale 521, and is fastened on the main printer unit side. The rotary encoder 52 outputs a pulse signal each time a slit provided in the scale 521 passes through the detection section 522. Since the slits provided in the scale 521 successively pass through the detection section 522 according to the rotation amount of the transport roller 23, the rotation amount of the transport roller 23 is detected based on the output of the rotary encoder 52.

Then, when the paper is to be transported by a transport amount of one inch for example, the controller 60 drives the transport motor 22 until the rotary encoder 52 detects that the transport roller 23 has performed a full rotation. In this manner, the controller 60 drives the transport motor 22 until a rotation amount corresponding to a targeted transport amount (target transport amount) is detected by the rotary encoder 52 such that the paper is transported by the target transport amount.

Regarding the Transport Error

In this regard, the rotary encoder 52 directly detects the rotation amount of the transport roller 23, and strictly speaking does not detect the transport amount of the paper S. For this reason, when the rotation amount of the transport roller 23 and the transport amount of the paper S do not match, the rotary encoder 52 cannot accurately detect the transport amount of the paper S, resulting in a transport error (detection error). There are two types of transport error, namely, DC component transport error and AC component transport error.

DC component transport error refers to a predetermined amount of transport error produced when the transport roller has performed a full rotation. DC component transport error may be caused by the circumference of the transport roller 23 being different in each individual printer due to deviation in production and the like. In other words, DC component transport error is a transport error that occurs because the design circumference of the transport roller 23 and the actual circumference of the transport roller 23 are different. DC component transport error is constant regardless of the commencement position when the transport roller 23 performs a full rotation. However, due to the effect of paper friction and the like, the actual DC component transport error is a value that varies depending on a total transport amount of the paper (this is discussed later). In other words, the actual DC component transport error is a value that varies depending on the relative positional relationship of the paper S and the transport roller 23 (or the paper S and the head 41).

AC component transport error refers to a transport error corresponding to a location on a circumferential surface of the transport roller that is used during transport. AC component transport error varies in amount depending on the location on the circumferential surface of the transport roller that is used during transport. That is, AC component transport error is an amount that varies depending on the rotation position of the transport roller when transport commences and transport amount.

Figure 5:
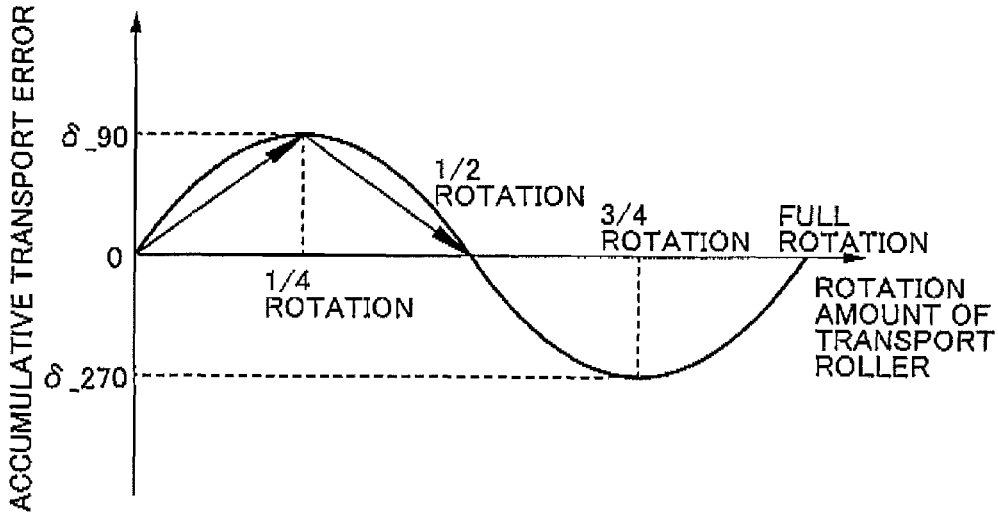
FIG. 5 is a graph for describing AC component transport error.

FIG. 5 is a graph for describing AC component transport error. The horizontal axis indicates the rotation amount of the transport roller 23 from a reference rotation position. The vertical axis indicates the transport error. When the graph is differentiated, the transport error produced when the transport roller performs transport at the corresponding rotation position is deduced. Here, the accumulative transport error at the reference position is set to zero and the DC component transport error is also set to zero.

When the transport roller 23 performs a ¼ rotation from the reference position, a transport error of δ_90 is produced, and the paper is transported by ¼ inch+δ_90. However, when the transport roller 23 performs a further ¼ rotation, a transport error of −δ_90 is produced, and the paper is transported by ¼ inch−δ_90.

The following three causes for example are conceivable as causes of AC component transport error.

First, influence due to the shape of the transport roller is conceivable. For example, when the transport roller is elliptical or egg shaped, the distance to the rotational center varies depending on the location on the circumferential surface of the transport roller. And when the medium is transported at an area where the distance to the rotational center is long, the transport amount increases with respect to the rotation amount of the transport roller. On the other hand, when the medium is transported at an area where the distance to the rotational center is short, the transport amount decreases with respect to the rotation amount of the transport roller.

Secondly, an eccentricity of the rotational axis of the transport roller is conceivable. In this case too, the length to the rotational center varies depending on the location on the circumferential surface of the transport roller. For this reason, even if the rotation amount of the transport roller is the same, the transport amount varies depending on the location on the circumferential surface of the transport roller.

Thirdly, inconsistency between the rotational axis of the transport roller and the center of the scale 521 of the rotary encoder 52 is conceivable. In this case, the scale 521 rotates eccentrically. As a result, the rotation amount of the transport roller 23 varies with respect to the detected pulse signals depending on the location of the scale 521 detected by the detection section 522. For example, when the detected location of the scale 521 is apart from the rotational axis of the transport roller 23, the rotation amount of the transport roller 23 becomes smaller with respect to the detected pulse signals, and therefore the transport amount becomes smaller. On the other hand, when the detected location of the scale 521 is close to the rotational axis of the transport roller 23, the rotation amount of the transport roller 23 becomes larger with respect to the detected pulse signals, and therefore the transport amount becomes larger.

As a result of these causes, the AC component transport error forms substantially a sine curve as shown in FIG. 5.

Transport Error Corrected by the Present Embodiment

Figure 6:
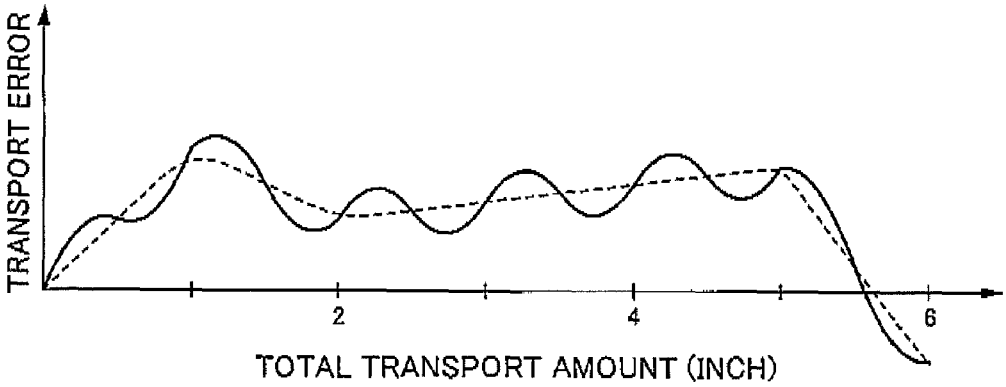
FIG. 6 is a graph (conceptual diagram) of transport error produced when transporting paper.

FIG. 6 is a graph (conceptual diagram) of the transport error produced when transporting paper of a size 101.6 mm×152.4 mm (4×6 inches). The horizontal axis in the graph indicates a total transport amount of the paper. The vertical axis in the graph indicates the transport error. The dotted line in FIG. 6 is a graph of DC component transport error. The AC component transport error is obtainable by subtracting the dotted line values (DC component transport error) in FIG. 6 from the solid line values (total transport error) in FIG. 6. Regardless of the total transport amount of the paper, the AC component transport error forms substantially a sine curve. On the other hand, due to the effect of paper friction and the like, the DC component transport error indicated by the dotted line is a value that varies depending on the total transport amount of the paper.

As has been described, the AC component transport error varies depending on the location on the circumferential surface of the transport roller 23. For this reason, even when transporting the same paper, the AC component transport error will vary if the rotation positions on the transport roller 23 at the commencement of transport are different, and therefore the total transport error (transport error indicated by the solid line on the graph) will vary. In contrast to this, unlike the AC component transport error, the DC component transport error has no relation to the location on the circumferential surface of the transport roller, and therefore even it the rotation position of the transport roller 23 varies at the commencement of transport, the transport error (DC component transport error) produced when the transport roller 23 has performed a full rotation is the same.

Furthermore, when attempting to correct the AC component transport error, it is necessary for the controller 60 to detect the rotation position of the transport roller 23. However, to detect the rotation position of the transport roller 23 it is necessary to further prepare an origin sensor for the rotary encoder 52, which results in increased costs.

Consequently, in the corrections of the transport amount according to the present embodiment shown below, the DC component transport error is corrected.

On the other hand, the DC component transport error is a value that varies (see the dotted line in FIG. 6) depending on the total transport amount of the paper (in other words, the relative positional relationship of the paper S and the transport roller 23). For this reason, if a greater number of correction values can be prepared corresponding to transport direction positions, fine corrections of the transport error can be achieved. Consequently, in the present embodiment, correction values for correcting the DC component transport error are prepared for each ¼ inch range rather than for each one inch range that corresponds to a full rotation of the transport roller 23.

Incidentally, depending on the arrangement of the roller in the printer, the paper S includes a portion that is steadily transported and a portion that is not steadily transported. Here, the portion that is steadily transported is the portion for which the transport error amount is constant whenever the paper S is transported. On the other hand, the portion that is not steadily transported is the portion for which the transport error amount is different each time the paper S is transported.

FIG. 7 is a diagram showing transport error for the portion that is steadily transported and the portion that is not steadily transported during transport of the paper S. The vertical axis in FIG. 7 represents the transport error and the horizontal axis the position corresponding to the total transport amount of the paper S. When the paper S can be steadily transported for the entire region thereof, the transport error as shown by the solid line in FIG. 7 occurs every time. However, a certain position of the paper S may be subject to a transport error such as that shown by the broken lines in FIG. 7, when transport errors are obtained for plural times. Such a position is a portion corresponding to the moment the paper S reaches the toothed rollers 27, and a portion corresponding to the moment the paper S ceases to be secured by the toothed rollers 27.

FIG. 8A is a diagram showing a state A in which the paper reaches the toothed rollers 27, and FIG. 8B is a diagram showing a state 2 in which the paper reaches the toothed rollers 27. In FIG. 8A, the paper reaches the toothed rollers 27 at a concave portion between teeth thereof, while in FIG. 8B the paper contacts the top portion of a tooth of the toothed rollers 27 when it reaches the toothed rollers 27. In this manner, the way in which the front end of the paper S contacts the roller when it reaches the toothed rollers 27 differs depending on the position of the teeth of the toothed rollers 27. Accordingly, the paper receives different levels of force when it is forwarded while contacting the top portion of a tooth of the toothed rollers 27 and when it is forwarded while contacting the base portion. As a result, the corresponding transport error may vary every time.

Figure 9A:
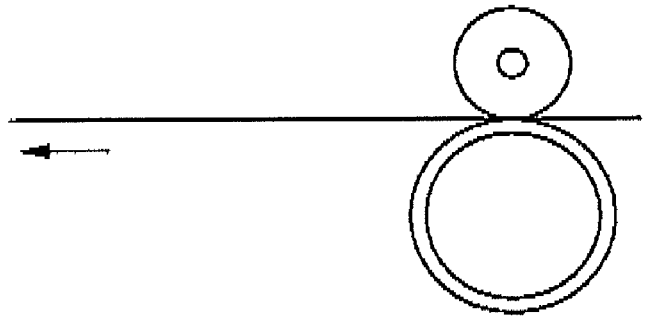
FIG. 9A is a diagram showing a state before the paper ceases to be secured by a transport roller.
Figure 9B:
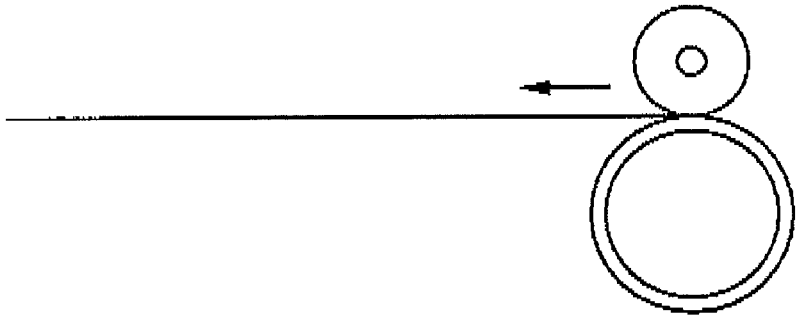
FIG. 9B is a diagram showing the moment the paper ceases to be secured by the transport roller.

FIG. 9A is a diagram showing a state before the paper ceases to be secured by the transport roller, and FIG. 9B is a diagram showing the very moment the paper ceases to be secured by the transport roller. The driven roller that makes a pair with the transport roller is made up of an elastic body such as rubber. Accordingly, when the paper S is transported as shown in FIG. 9A, a pressing force is applied to the paper S, which is sandwiched between the transport roller and the driven roller, due to elastic force. As described above, since the driven roller is made up of an elastic body, a force of flipping the paper S in the transport direction is applied to the paper S at the moment the paper S ceases to be sandwiched between the transport roller and the driven roller, as shown in FIG. 9B. This force of flipping the paper S varies every time, which makes the corresponding transport errors vary every time.

In the present embodiment, the correction values are obtained in the following manner such that sufficiently good transport amount correction can be performed even for the transport at a relative position where the transport error value is not constant.

Outline Description

Figure 10:
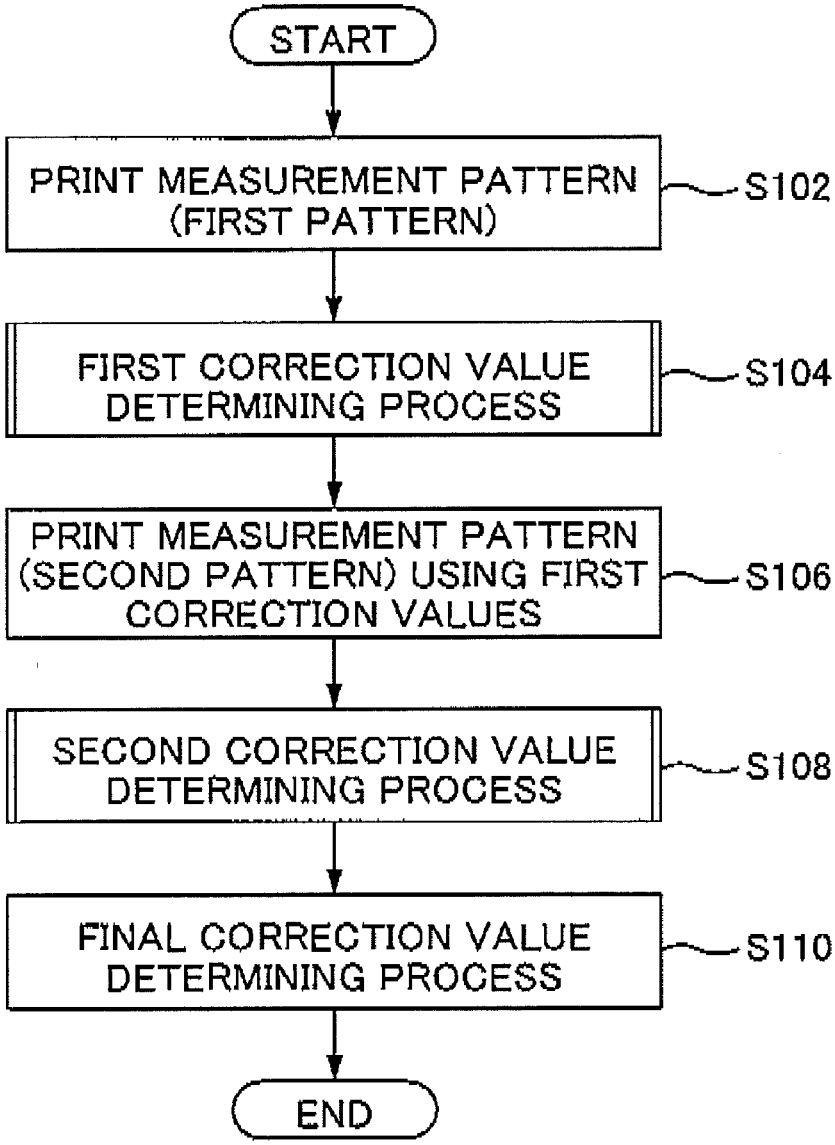
FIG. 10 is a flowchart showing up to determining correction values for correcting the transport amount.
Figure 11A:
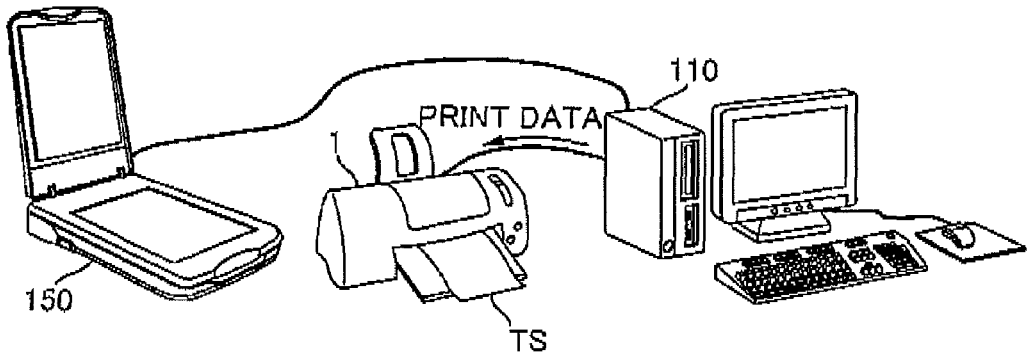
FIGS. 11A to 11C are diagrams for describing the data flow up to determining the correction values.
Figure 11B:
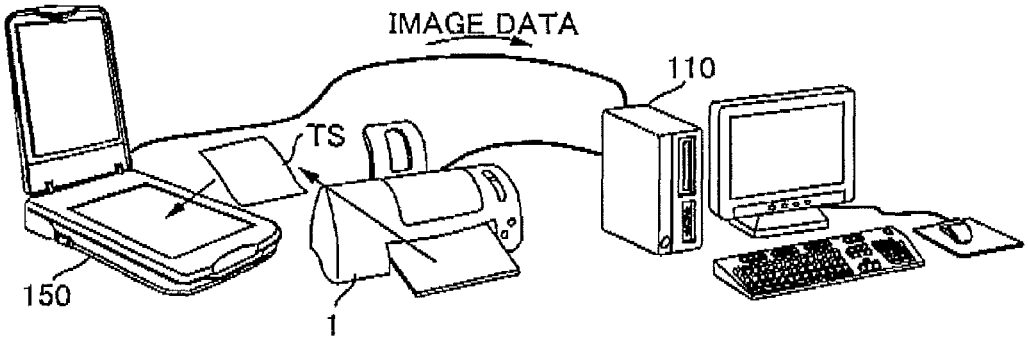
Figure 11C:
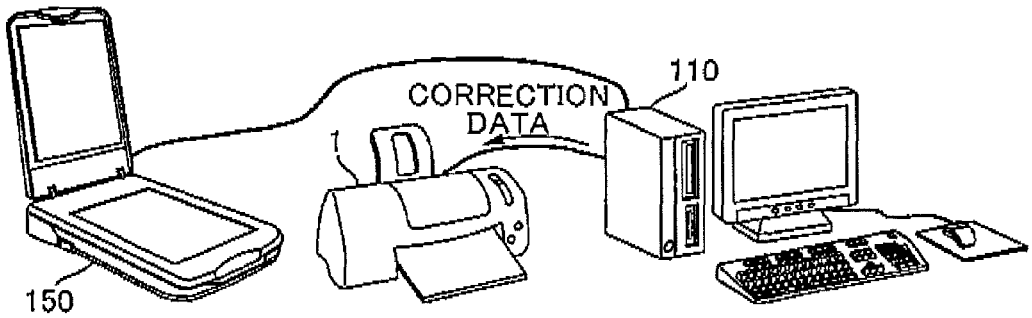

FIG. 10 is a flowchart up to the determination of the correction values for correcting transport amounts. FIGS. 11A to 11C are diagrams for describing the data flow up to determining the correction values. These processes are carried out in an inspection process at a printer manufacturing factory. Prior to this process, an inspector connects a printer 1 that is fully assembled to a computer 110 at the factory. The computer 110 at the factory is connected to a scanner 150 as well, and is preinstalled with a printer driver, a scanner driver, and the like.

First, the computer 110 transmits print data to the printer 1. Then, the printer 1 prints a measurement pattern (first pattern) on a test sheet TS (S102, FIG. 11A). Next, the inspector places the test sheet TS in the scanner 150. Then, the scanner driver causes the scanner 150 to read the measurement pattern, and transmits the image data to the computer 110 (FIG. 11B). The computer 110 obtains first correction values based on the transmitted image data. The computer 110 transmits the corrected data to the printer 1, causes the first correction values to be stored in the memory 63 of the printer 1 (S104, FIG. 11C).

Next, the computer 110 transmits print data to the printer 1. The printer 1 prints the measurement pattern again (second pattern) using the first correction values (S106, FIG. 11A). The inspector places this test sheet TS in the scanner 150. The scanner driver causes the scanner 150 to read the measurement pattern, and transmits the image data to the computer 110 (FIG. 11B). The computer 110 obtains second correction values based on the transmitted image data. The computer 110 obtains correction values (final correction values) based on the first and second correction values (S110). These correction values are stored in the memory 63 of the printer 1 (FIG. 11C). The correction values stored in the printer reflect the transport characteristics of individual printers.

The printer 1 in which the correction values are stored is delivered to the user. Then, when the user prints an image with the printer 1, the printer 1 transports paper based on the correction values, and prints the image on paper.

The calculation of the correction values is carried out twice as described above because of the following reason. Firstly, by obtaining first correction values and applying them during transport, it is possible to remove a large portion of the transport error corresponding to the portion that is steadily transported. Secondly, second correction values are obtained by applying the first correction values during transport. Then, by using the sums of the first and second correction values, it is possible to perform more precise transport amount correction.

On the other hand, first correction values corresponding to the portion that is not steadily transported, are those obtained based on inconsistent transport errors. Also, second correction values corresponding to the portion that is not steadily transported are also those obtained based on inconsistent transport errors as the first correction values. Therefore, with respect to the correction values corresponding to the portion that is not steadily transported, a median value of a first correction value and the sum of the first correction value and a second correction value is used. Through this, for the correction values corresponding to the portion that is not steadily transported, the correction values obtained based on the inconsistent transport errors are averaged and used. As the correction values corresponding to the portion that is not steadily transported, the correction values are used that remove the transport error that is expected to occur on an average basis.

Printing of Measurement Pattern (S102)

First, the printing of the measurement pattern is described. As with ordinary printing, the printer 1 prints the measurement pattern on paper by alternately repeating a dot forming process, in which dots are formed by ejecting ink from moving nozzles, and a transport operation in which the paper is transported in the transport direction. It should be noted that in the description hereinafter, the dot forming process is referred to as a "pass" and an n-th dot forming process is referred to as "pass n".

Figure 12:
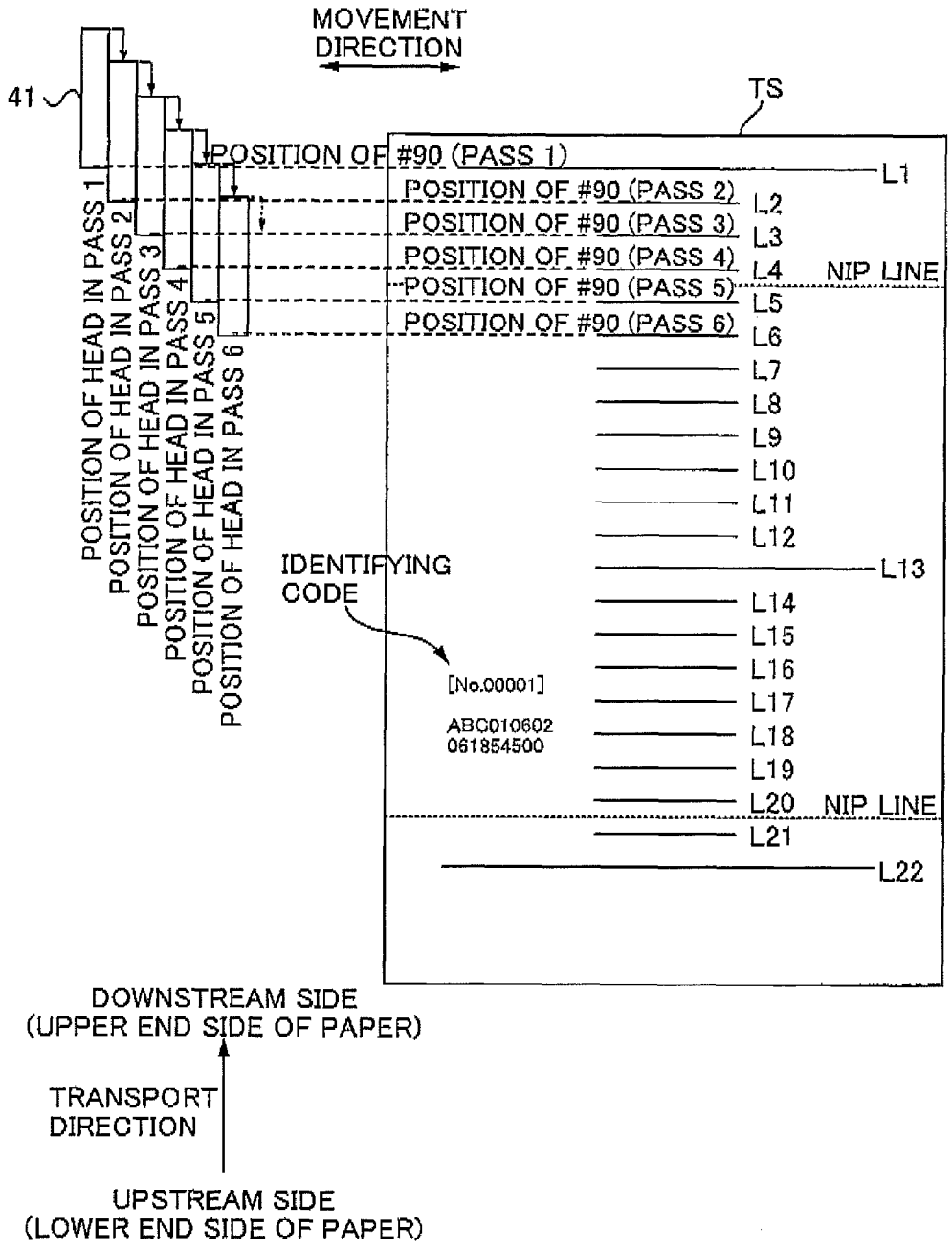
FIG. 12 is an explanatory diagram illustrating a state of printing a measurement pattern.

FIG. 12 is an explanatory diagram illustrating a state of printing a measurement pattern. The size of a test sheet TS on which the measurement pattern is to be printed is 101.6 mm×152.4 mm (4×6 inches).

The measurement pattern printed on the test sheet TS is shown on the right side of FIG. 12. The rectangles on the left side of FIG. 12 indicate the position (the relative position with respect to the test sheet TS) of the head 41 at each pass. To facilitate description, the head 41 is illustrated as if moving with respect to the test sheet TS, but FIG. 12 shows the relative positional relationship of the head and the test sheet TS and in fact the test sheet TS is being transported intermittently in the transport direction.

When the test sheet TS is transported, the upper end of the test sheet TS passes over the discharge rollers 25. The position on the test sheet TS in opposition to the furthest upstream nozzle #90 when the upper end of the test sheet TS passes over the discharge rollers 25 is shown by a dotted line in FIG. 12 as a "NIP line" on the upper end side. That is, in passes where the head 41 is lower than the NIP line on the upper end side in FIG. 12, printing is carried out in a state in which the test sheet TS is sandwiched between the discharge rollers 25 and the toothed rollers 27 (also referred to as a "NIP state"). Furthermore, in passes where the head 41 is higher than the NIP line on the upper end side in FIG. 12, printing is carried out in a state in which the test sheet TS is not held between the discharge rollers 25 and the toothed rollers 27 (which is a state in which the test sheet TS is transported by only the transport roller 23 and the driven rollers 26, and is also referred to as a "non NIP state").

When the test sheet TS continues to be transported, the lower end of the test sheet TS passes over the transport roller 23. The position on the test sheet TS in opposition to the furthest upstream nozzle #90 when the lower end of the test sheet TS passes over the transport roller 23 is shown by a dotted line in FIG. 12 as a "NIP line" on the lower end side. That is, in passes where the head 41 is higher than the NIP line on the lower end side in FIG. 12, printing is carried out in a state in which the test sheet TS is sandwiched between the transport roller 23 and the driven rollers 26 (also referred to as a "NIP state"). Furthermore, in passes where the head 41 is lower than the NIP line in FIG. 12, printing is carried out in a state in which the test sheet TS is not held between the transport roller 23 and the driven rollers 26 (which is a state in which the test sheet TS is transported by only the discharge rollers 25 and the driven rollers 27 and is also referred to as a "non NIP state").

The measurement pattern is constituted by an identifying code and a plurality of lines.

The identifying code is a symbol for individual identification for identifying each of the individual printers 1 respectively. The identifying code is also read together when the measurement pattern is read in S104 and S108, and is identified in the computer 110 using OCR character recognition.

Each of the lines is formed in the movement direction. Starting from the upper end side, the i-th line is called "Li". Specific lines are formed longer than other lines. For example, line L1, line L13, and line L22 are formed longer than the other lines. These lines are formed as follows.

First, after the test sheet TS is transported to a predetermined print commencement position, ink droplets are ejected only from nozzle #90 in pass 1, thereby forming the line L1. After pass 1, the controller 60 causes the transport roller 23 to perform a ¼ rotation so that the test sheet TS is transported by approximately ¼ inch. After transport, ink droplets are ejected only from nozzle #90 in pass 2, thereby forming the line L2. Thereafter, the same operation is repeated and the lines L1 to L22 are formed at intervals of approximately ¼ inch. In this manner, the lines L1 to L22 are formed using the furthest upstream nozzle #90 only of nozzles #1 to #90. It should be noted that although the lines L1 to L22 are formed using only nozzle #90, nozzles other than the nozzle #90 are used when printing the identifying code in the pass in which the identifying code is printed.

Incidentally, when transport of the test sheet TS is carried out ideally, the interval between the lines from line L1 to line L22 should be precisely ¼ inch. However, when there is a transport error, the line interval is not ¼ inch. If the test sheet TS is transported more than an ideal transport amount, then the line interval widens. Conversely, it the test sheet TS is transported less than an ideal transport amount, then the line interval narrows. That is, the interval between certain two lines reflects the transport error in the transport process between a pass in which one of the lines is formed and a pass in which the other of the lines is formed. For this reason, by measuring the interval between two lines, it is possible to measure the transport error in the transport process carried out between a pass in which one of the lines is formed and a pass in which the other of the lines is formed.

First Correction Value Determining Process (S104)

Figure 13:
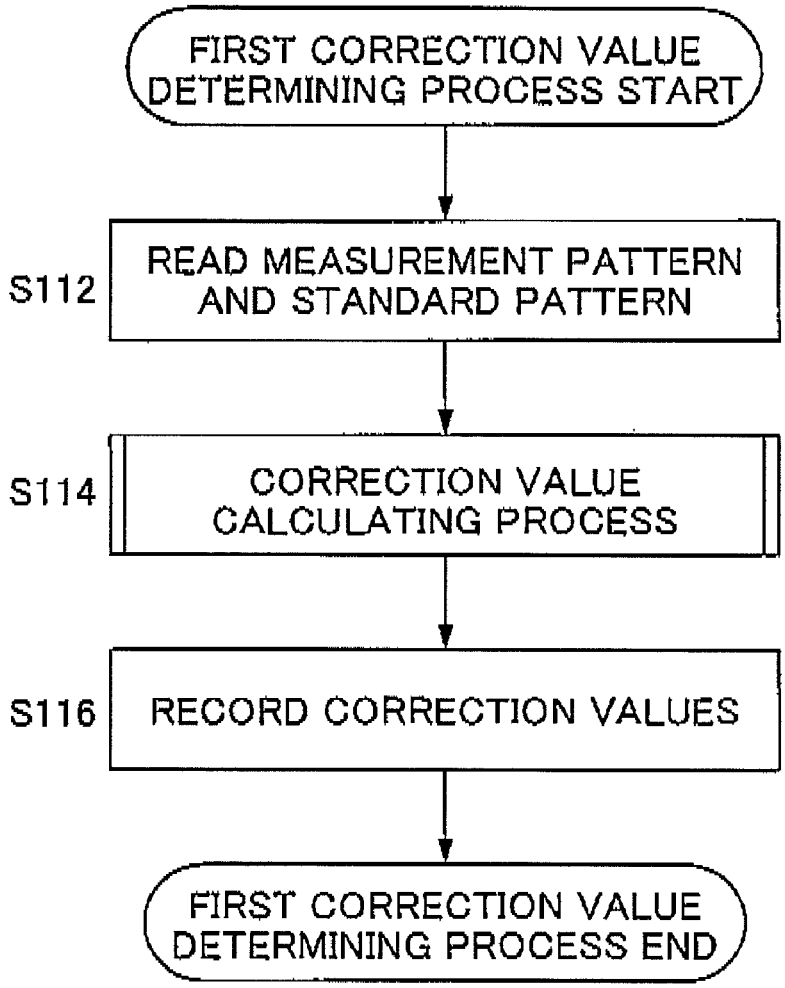
FIG. 13 is a flowchart for describing a first correction value determining process.

FIG. 13 is a flowchart describing the first correction value determining process. Respective processes in the correction value determining process are described below.

Reading Measurement Pattern and Standard Pattern (S112)

Scanner Configuration

First, the configuration of the scanner 150 used in reading the measurement pattern is described.

Figure 14A:
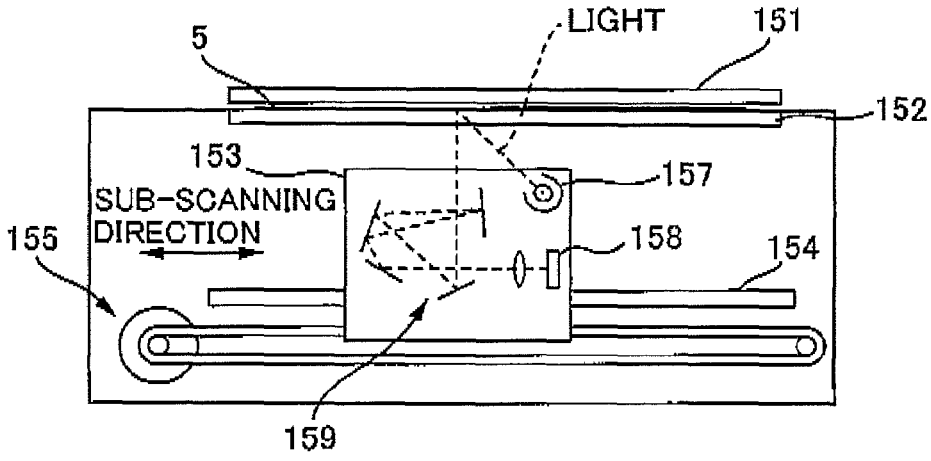
FIG. 14A is a vertical cross-sectional view of a scanner 150.
Figure 14B:
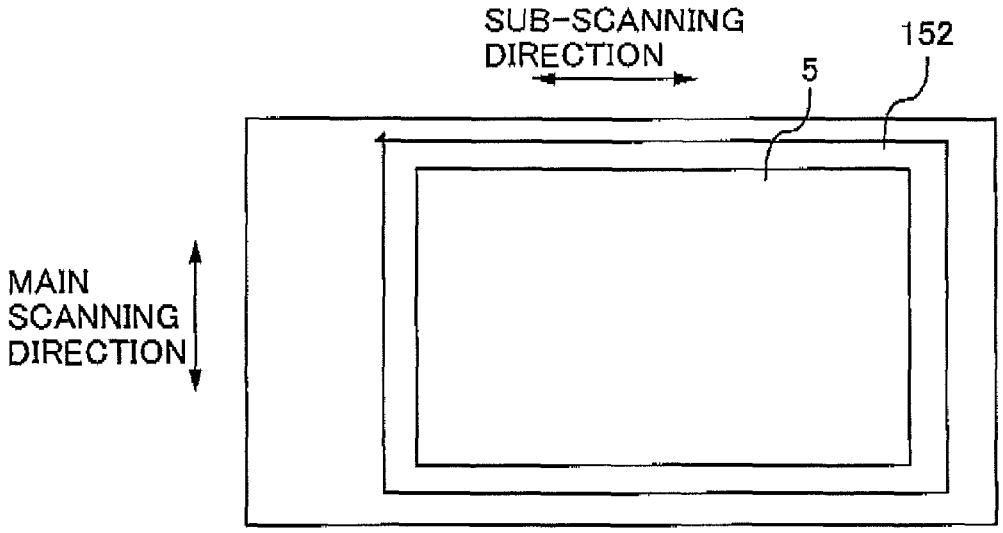
FIG. 14B is a plan view of the scanner 150 with an upper cover 151 removed.

FIG. 14A is a vertical cross-sectional view of the scanner 150. FIG. 14B is a top view of the scanner 150 with an upper cover 151 removed.

The scanner 150 is provided with the upper cover 151, a platen glass 152 on which a document 5 is placed, and a reading carriage 153 that moves in a sub-scanning direction while opposing the document 5 via the platen glass 152, a guiding member 154 that guides the reading carriage 153 in the sub-scanning direction, a moving mechanism 155 for moving the reading carriage 153, and a scanner controller (not shown) that controls each section of the scanner 150. The reading carriage 153 is provided with an exposure lamp 157 for irradiating the document 5 with light, a line sensor 158 that detects an image of a line in the main scanning direction (direction perpendicular to the paper surface in FIG. 14A) and an optical system 159 for guiding light reflected by the document 5 to the line sensor 158. The broken line in the reading carriage 153 of FIG. 14A indicates the light trajectory.

When reading an image of the document 5, an operator opens the upper cover 151 and places the document 5 on the platen glass 152, and closes the upper cover 151. Then, the scanner controller causes the reading carriage 153 to move along the sub-scanning direction while causing the exposure lamp 157 to emit light, and reads the image on the surface of the document S with the line sensor 158. The scanner controller transmits the image data that is read to a scanner driver of the computer 110, and the computer 110 obtains the image data of the document 5.

Reading Position Accuracy

As is described later, in the present embodiment, the scanner 150 scans the measurement pattern of the test sheet TS and the standard pattern of the standard sheet at a resolution of 720 dpi (main scanning direction)×720 dpi (sub-scanning direction). Thus, in the following description, an image reading resolution of 720×720 dpi is assumed.

Figure 15:
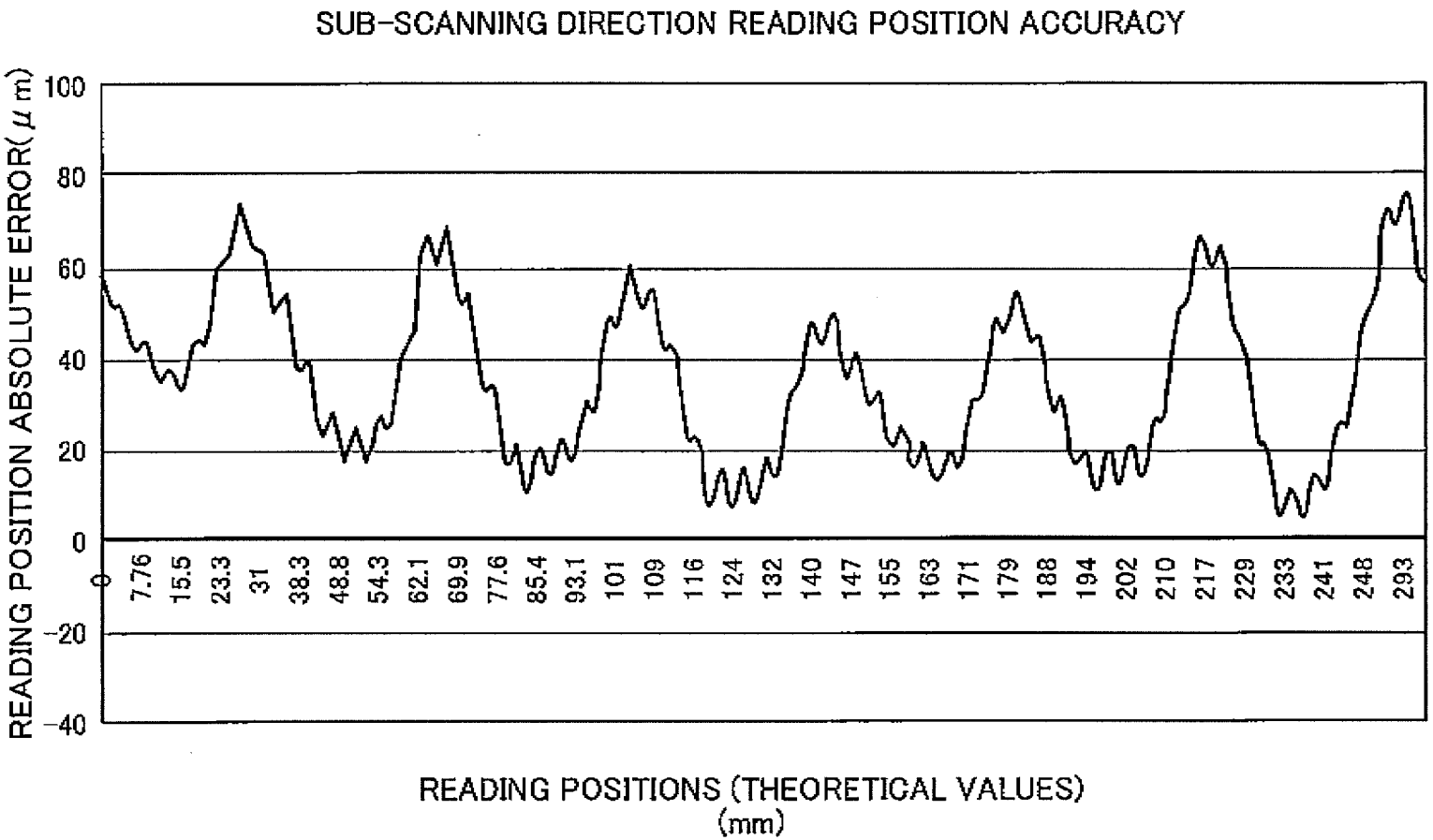
FIG. 15 is a graph of the reading position error of a scanner.

FIG. 15 is a graph of the reading position error of the scanner. The horizontal axis in the graph indicates reading positions (theoretical values) (that is, the horizontal axis in the graph indicates positions (theoretical values) of the reading carriage 153). The vertical axis in the graph indicates reading position error (difference between the theoretical values of reading positions and actual reading positions). For example, when the reading carriage 153 is caused to move 1 inch (=25.4 mm), an error of approximately 60 μm is produced.

Suppose that the theoretical value of the reading position and the actual reading position match, a pixel that is 720 pixels apart in the sub-scanning direction from a pixel indicating a reference position (a position where the reading position is zero) should indicate an image in a position precisely one inch from the reference position. However, when a reading position error occurs as shown in the graph, the pixel that is 720 pixels apart in the sub-scanning direction from the pixel indicating a reference position indicates an image in a position that is a further 60 μm apart from the position that is one inch apart from the reference position.

Furthermore, suppose that there is zero tilt in the graph, the image should be read having a uniform interval each 1/720 inch. However, when the graph is tilted to the positive side, the image is read at an interval longer than 1/720 inch. And when the graph is tilted to the negative side, the image is read at an interval shorter than 1/720 inch.

As a result, even supposing the lines of the measurement pattern are formed having uniform intervals, the line images in the image data will not have uniform intervals in a state in which there is reading position error. In this manner, in a state in which there is reading position error, line positions cannot be accurately measured by simply reading the measurement pattern.

Consequently, in the present embodiment, when the test sheet TS is set and the measurement pattern is read by the scanner, a standard sheet is set and a standard pattern is also read.

Reading Measurement Pattern and Standard Pattern

Figure 16A:
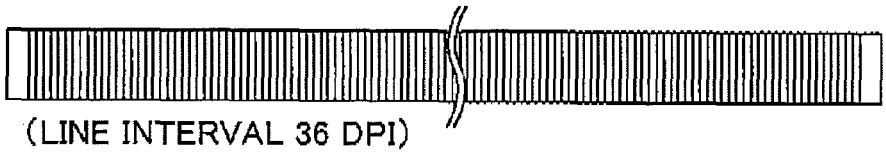
FIG. 16A is an explanatory diagram of a standard sheet SS.
Figure 16B:
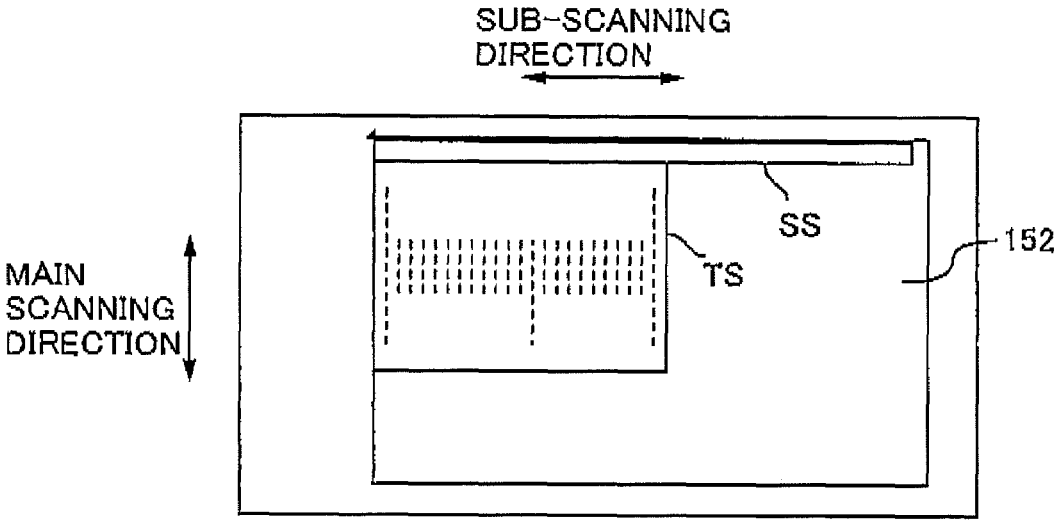
FIG. 16B is an explanatory diagram of a state in which a test sheet TS and the standard sheet SS are set on a platen glass 152.

FIG. 16A is an explanatory diagram of a standard sheet SS. FIG. 16B is an explanatory diagram of a condition in which the test sheet TS and the standard sheet SS are set on the platen glass 152.

A size of the standard sheet SS is 10 mm×300 mm such that the standard sheet SS has a long narrow shape. A multitude of lines are formed as a standard pattern at intervals of 36 dpi on the standard sheet SS. Since it is used repetitively, the standard sheet SS is constituted not by paper but rather by a PET film. Furthermore, the standard pattern is formed with high precision using laser processing.

The test sheet TS and the standard sheet SS are set in a predetermined position on the platen glass 152 using a jig not shown in the drawings. The standard sheet SS is set on the platen glass 152 so that its long sides are parallel to the sub-scanning direction of the scanner 150, that is, so that each line of the standard sheet SS is parallel to the main scanning direction of the scanner 150. The test sheet TS is set beside the standard sheet SS. The test sheet TS is set on the platen glass 152 so that its long sides are parallel to the sub-scanning direction of the scanner 150, that is, so that each line of the measurement pattern is parallel in the main scanning direction.

With the test sheet TS and the standard sheet SS set in this state, the scanner 150 reads the measurement pattern and the standard pattern. At this time, due to the influence of reading position error, the image of the measurement pattern in the reading result is a distorted image compared to the actual measurement pattern. Similarly, the image of the standard pattern is also a distorted image compared to the actual standard pattern.

It should be noted that the image of the measurement pattern in the reading result receives not only the influence of the reading position error, but also the influence of the transport error of the printer 1. On the other hand, the standard pattern is formed having uniform intervals without any relation to the transport error of the printer, and therefore the image of the standard pattern receives the influence of the reading position error in the scanner 150, but does not receive the influence of the transport error of the printer 1.

Consequently, the computer 110 cancels the influence of the reading position error in the image of the measurement pattern based on the image of the standard pattern when calculating correction values based on the image of the measurement pattern.

Correction Value Calculating Process (S114)

Before describing the calculation of correction values, the image data obtained from the scanner 150 is described. Image data is constituted by a plurality of pixel data. The data for each pixel indicates a tone value of the corresponding pixel. Ignoring the scanner reading error, each pixel corresponds to a size of 1/720×1/720 inches. An image (digital image) is constituted by pixels such as these as a smallest structural unit, and image data represents an image such as this.

Figure 17:
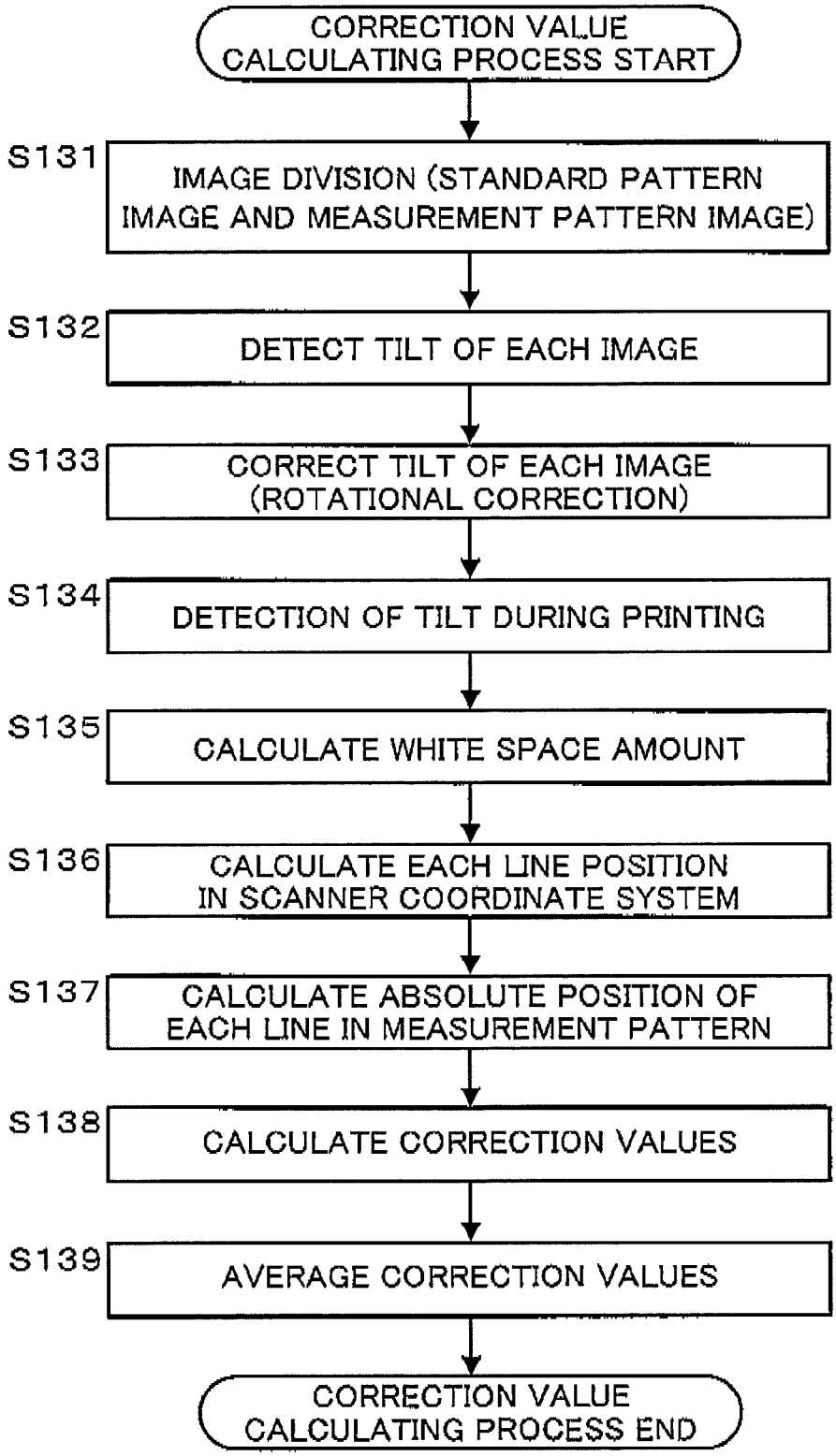
FIG. 17 is a flowchart of a correction value calculating process in S114.

FIG. 17 is a flowchart of a correction value calculating process in S114. This correction value calculating process is carried out by the computer 110 executing a predetermined program.

Image Division (S131)

First, the computer 110 divides (S131) the image representing the image data obtained from the scanner 150 into two.

Figure 18:
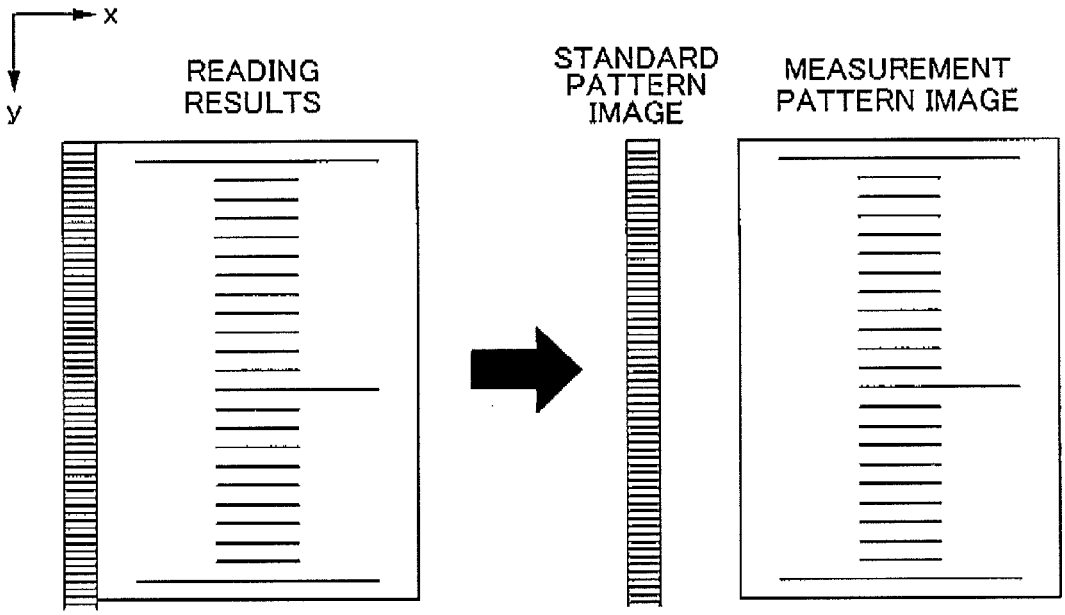
FIG. 18 is an explanatory diagram of image division (S131)

FIG. 18 is an explanatory diagram of image division (S131). On the left side of FIG. 18, an image is drawn indicating image data obtained from the scanner. On the right side of FIG. 18, a divided image is shown. In the following description, the left-right direction (horizontal direction) in FIG. 18 is referred to as the x direction and the up-down direction (vertical direction) in FIG. 18 is referred to as the y direction. The lines in the image of the standard pattern are substantially parallel to the x direction and the lines in the image of the measurement pattern are substantially parallel to the y direction.

The computer 110 divides the image into two by extracting an image of a predetermined range from the image of the reading result. By dividing the image of the reading result into two, one of the images indicates an image of the standard pattern and the other of the images indicates an image of the measurement pattern. A reason for dividing in this manner is that since there is a risk that the standard sheet SS and the test sheet TS are set in the scanner 150 with different tilts, tilt correction (S133) is performed on these separately.

Image Tilt Detection (S132)

Next, the computer 110 detects the tilt of the images (S132).

Figure 19A:
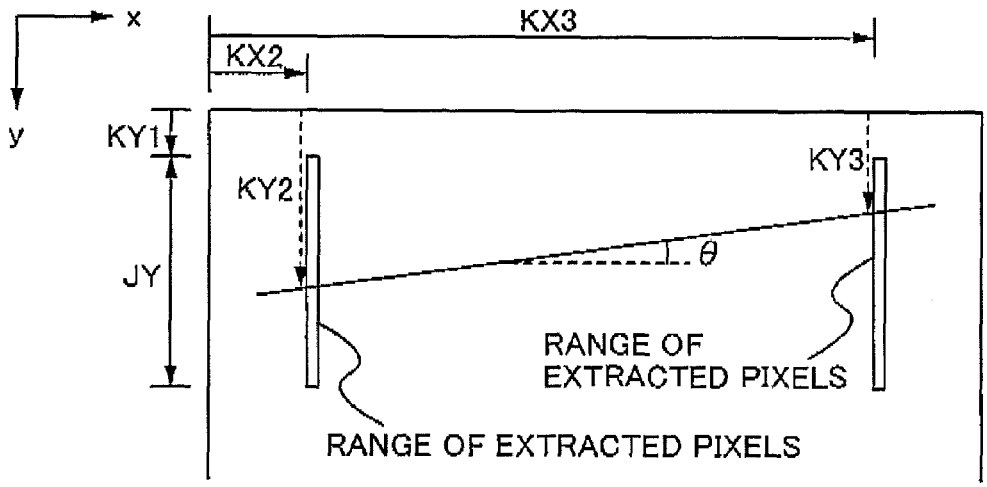
FIG. 19A is an explanatory diagram of a state in which tilt of an image of the measurement pattern is detected.

FIG. 19A is an explanatory diagram of a state in which tilt of the image of the measurement pattern is detected. The computer 110 extracts from the image data JY pixels from the KY1-th pixel from the top of the KX2-th pixels from the left. Similarly, the computer 110 extracts from the image data JY pixels from the KY1-th pixel from the top of the KX3-th pixels from the left. It should be noted that the parameters KX2, KX3, KY1, and JY are set so that pixels indicating the line L1 are contained in the extracted pixels.

Figure 19B:
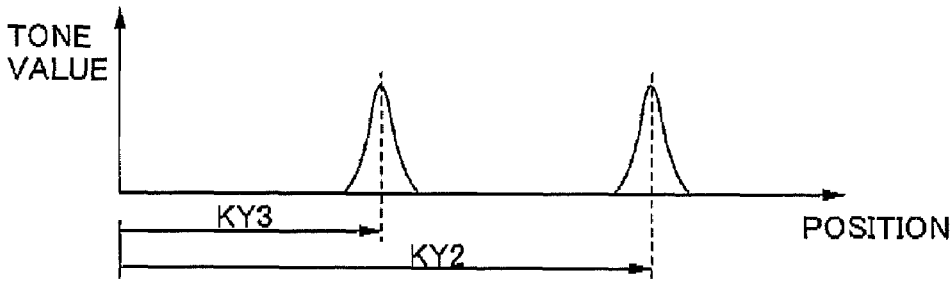
FIG. 19B is a graph of tone values of extracted pixels.

FIG. 19B is a graph of tone values of the extracted pixels. The horizontal axis indicates pixel positions (Y coordinates). The vertical axis indicates the tone values of the pixels. The computer 110 obtains centroid positions KY2 and KY3 respectively based on pixel data of the JY pixels that have been extracted.

Then, the computer 110 calculates a tilt θ of the line L1 using the following expression:

$$\theta=\tan^{-1}\{(KY2-KY3)/(KX2-KX3)\}$$

It should be noted that the computer 110 detects not only the tilt of the image of the measurement pattern but also the tilt of the image of the standard pattern. The method for detecting the tilt of the image of the standard pattern is substantially the same as the method described above, and therefore its description is omitted.

Image Tilt Correction (S133)

Next, the computer 110 corrects the image tilt by performing a rotation process on the image based on the tilt θ detected at S132 (S133). The image of the measurement pattern is rotationally corrected based on a tilt result of the image of the measurement pattern, and the image of the standard pattern is rotationally corrected based on a tilt result of the image of the standard pattern.

A bilinear technique is used in an algorithm for the rotation process of the image. This algorithm is well known, and therefore its description is omitted.

Tilt Detection During Printing (S134)

Next, the computer 110 detects the tilt (skew) during printing of the measurement pattern (S134). When the lower end of the test sheet passes the transport roller while printing the measurement pattern, sometimes the lower end of the test sheet contacts the head 41 and the test sheet moves. When this occurs, the correction values calculated using this measurement pattern become inappropriate. Consequently, whether or not the lower end of the test sheet has made contact with the head 41 is detected by detecting the tilt at the time of printing the measurement pattern, and if contact has been made, this is taken as an error.

Figure 20:
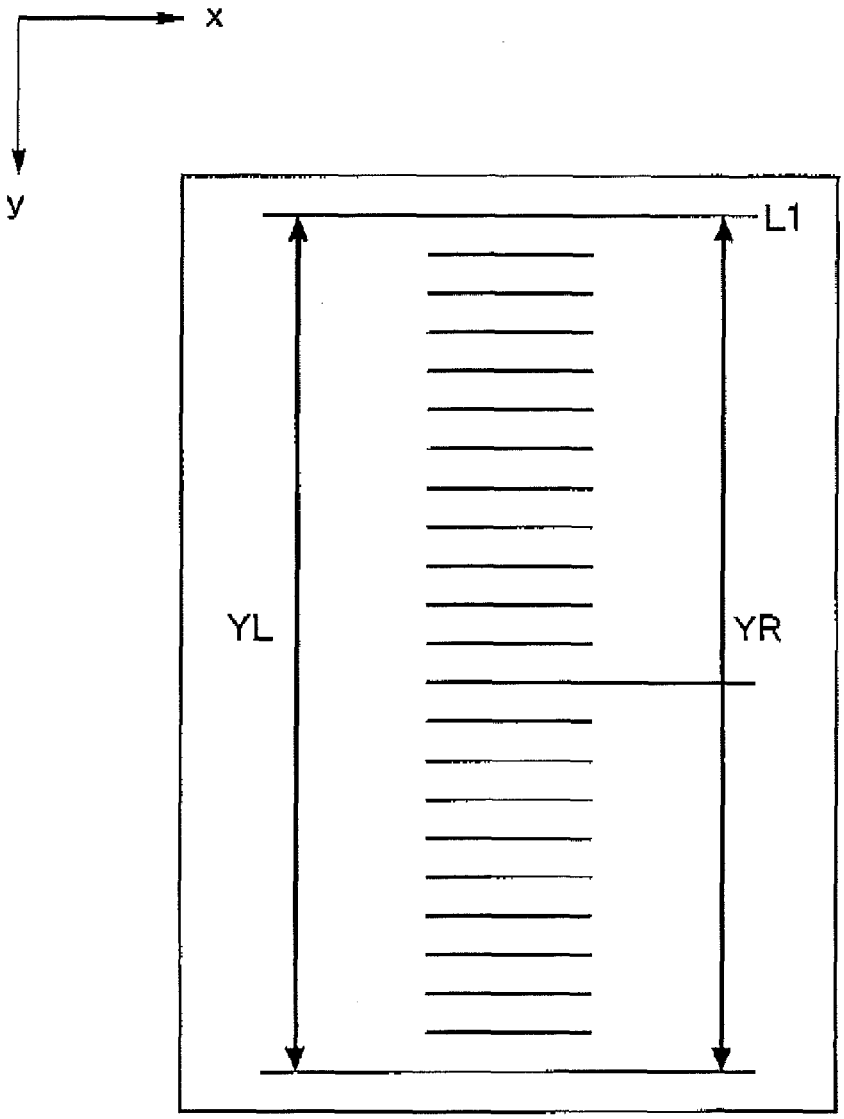
FIG. 20 is an explanatory diagram of a state in which tilt of the measurement pattern during printing is detected.

FIG. 20 is an explanatory diagram of a state in which tilt during printing of the measurement pattern is detected. First of all, the computer 110 detects an interval on the left side YL and an interval on the right side YR between the line L1 (the line at the top) and the line L22. Then the computer 110 calculates the difference between the interval YL and the interval YR and proceeds to the next process (S135) if this difference is within a predetermined range, but takes it as an error if this difference is outside the predetermined range.

Calculating Amount of White Space (S135)

Next, the computer 110 calculates the amount of white space (S135).

Figure 21:
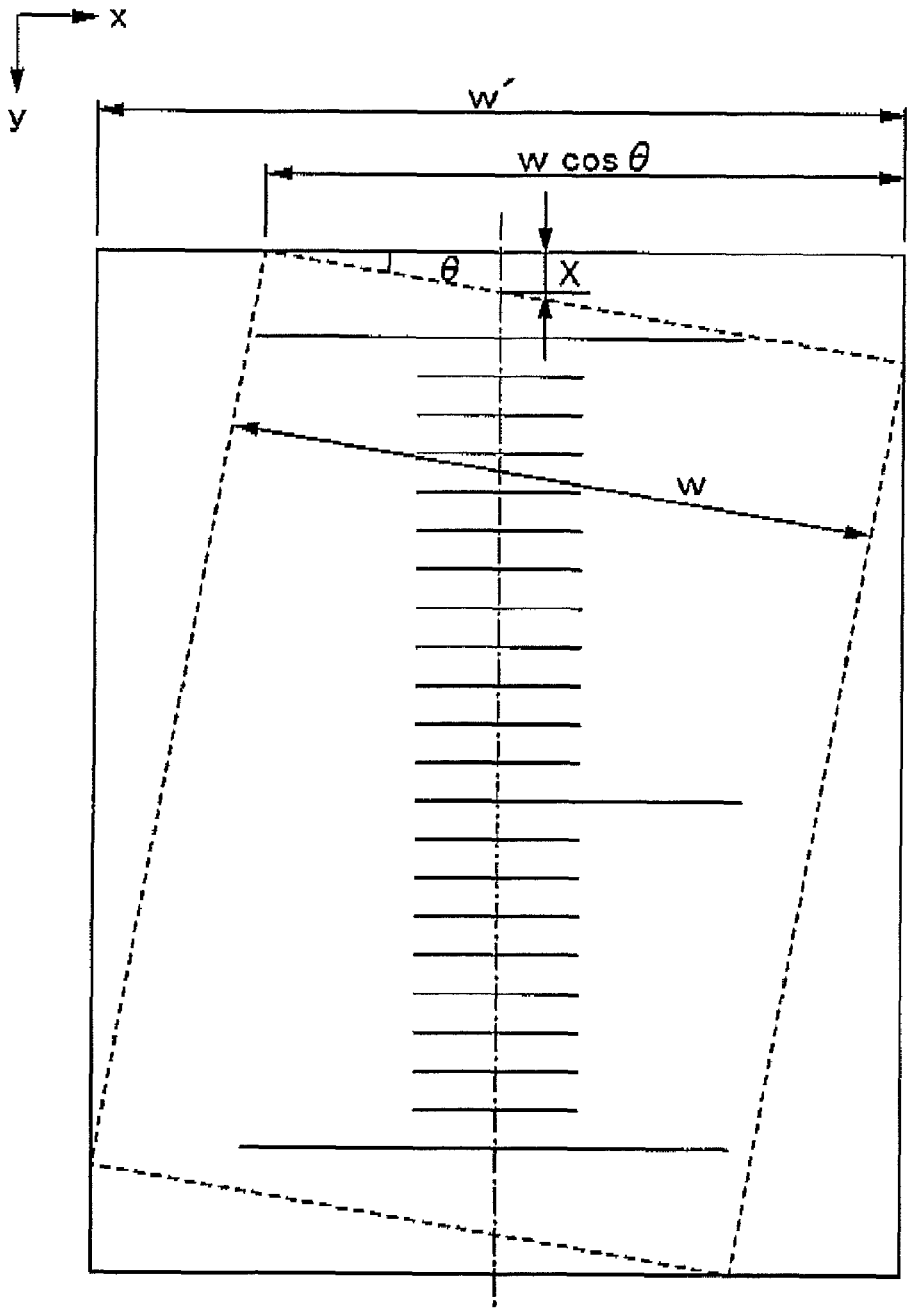
FIG. 21 is an explanatory diagram of a white space amount X.

FIG. 21 is an explanatory diagram of a white space amount X. The solid line quadrilateral (outer quadrilateral) in FIG. 21 indicates an image after rotational correction of S133. The dotted line quadrilateral (inner diagonal quadrilateral) in FIG. 21 indicates an image prior to the rotational correction. In order to make the image after rotational correction a rectangular shaper white spaces of right-angled triangle shapes are added to the four corners of the rotated image when carrying out the rotational correction process at S133.

Supposing the tilt of the standard sheet SS and the tilt of the test sheet TS are different, the added white space amount will be different, and the positions of the lines in the measurement pattern with respect to the standard pattern will be relatively shifted before and after the rotational correction (S133). Accordingly, the computer 110 obtains the white space amount X using the following expression and prevents displacement of the lines of the measurement pattern with respect to the standard pattern by subtracting the white space amount X from the line positions calculated in S136.

$$X=(w\cos\theta-W'/2)\times\tan\theta$$

Line Position Calculations in Scanner Coordinate System (S136)

Next, the computer 110 calculates the line positions of the standard pattern and the line positions of the measurement pattern respectively using a scanner coordinate system (S136).

The scanner coordinate system refers to a coordinate system when the size of one pixel is $1/720\times1/720$ inches. There is a reading position error in the scanner 150 and therefore when considering the reading position error, strictly speaking the actual region corresponding to each piece of pixel data does not become $1/720\times1/720$ inches, but in the scanner coordinate system the size of the region (pixels) corresponding to each piece of pixel data is assumed to be $1/720\times1/720$ inches. Furthermore, a position of the upper left pixel in each image is set as an origin in the scanner coordinate system.

Figure 22A:
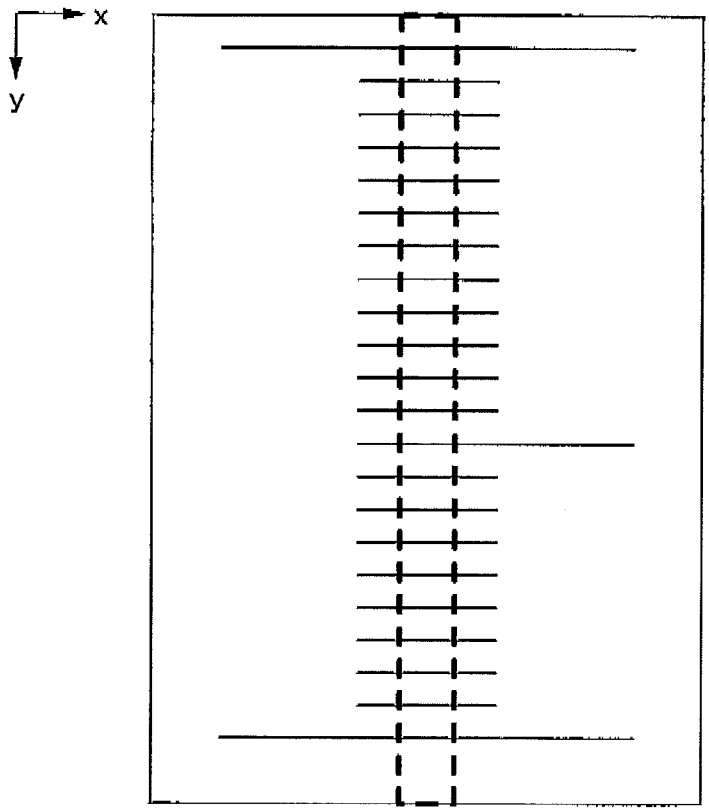
FIG. 22A is an explanatory diagram of an image range used in calculating line positions.
Figure 22B:
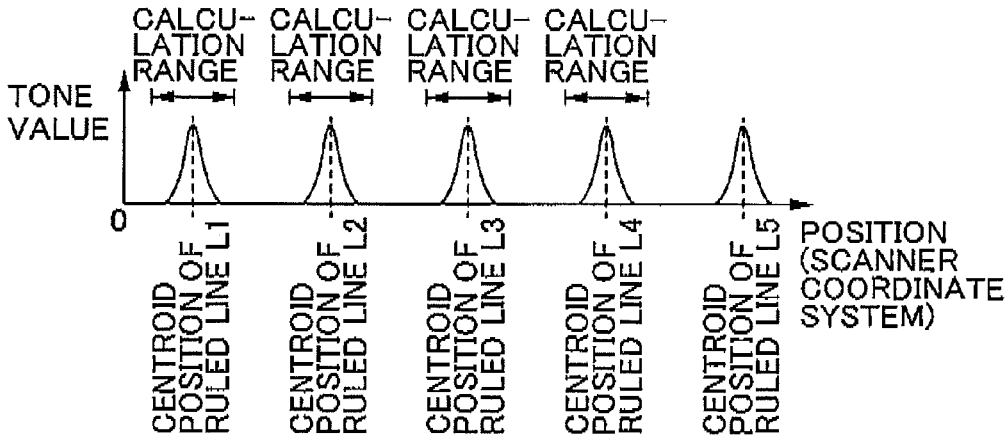
FIG. 22B is an explanatory diagram of calculating line positions.

FIG. 22A is an explanatory diagram of an image range used in calculating line positions. The image data of the image in the range indicated by the dotted line in FIG. 22A is used in calculating the line positions. FIG. 22B is an explanatory diagram of calculating line positions. The horizontal axis indicates the positions in the y direction of the pixels (scanner coordinate system). The vertical axis indicates tone values of the pixels (average values of tone values of the pixels lined up in the x direction).

The computer 110 obtains a position of a peak value of the tone values and sets a predetermined range centered on this position as a calculation range. Then, based on the pixel data of pixels in this calculation range, the centroid position of the tone values is calculated, and the calculated centroid position is set as the line position.

Figure 23:
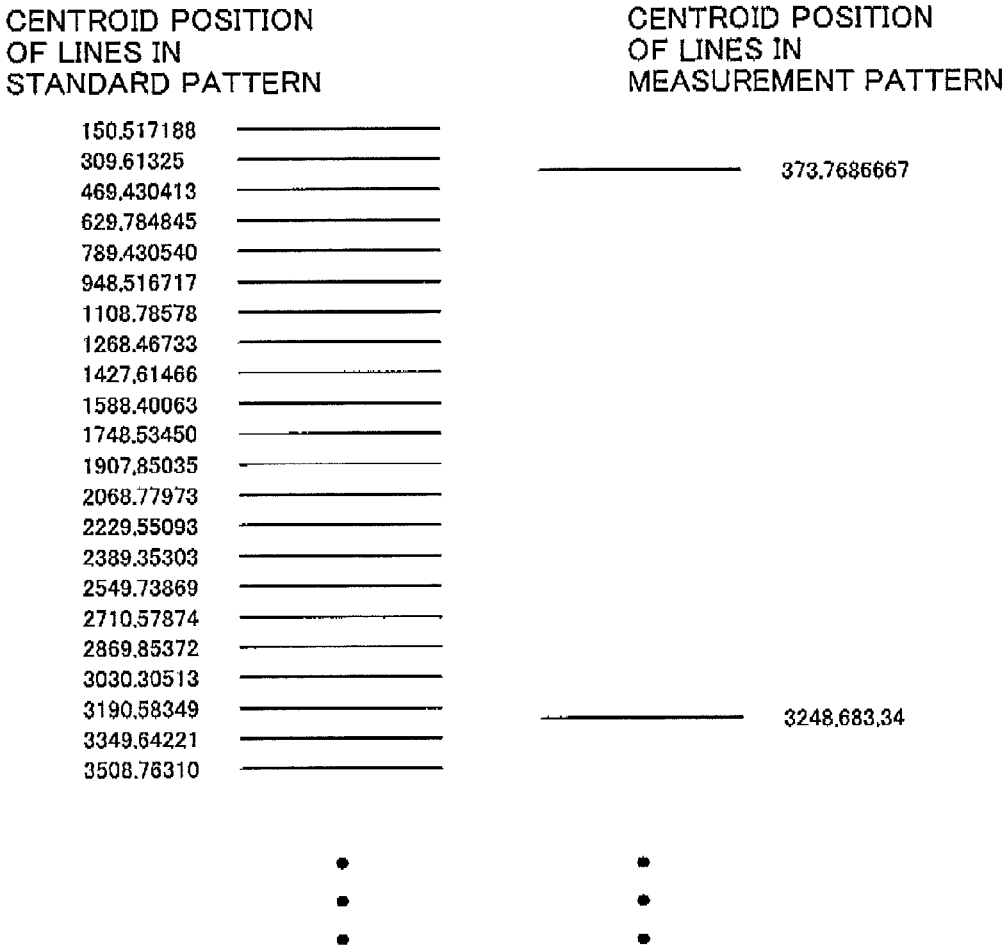
FIG. 23 is an explanatory diagram of calculated line positions.

FIG. 23 is an explanatory diagram of calculated line positions (note that positions shown in FIG. 23 have undergone a predetermined calculation to be made dimensionless). In regard to the standard pattern, despite being constituted by lines having uniform intervals, its calculated line positions do not have uniform intervals when attention is given to the centroid positions of each line in the standard pattern. This is conceivably an influence of reading position error of the scanner 150.

Calculating Absolute Positions of Lines in Measurement Pattern (S137)

Next, the computer 110 calculates the absolute positions of the lines in the measurement pattern (S137).

Figure 24:
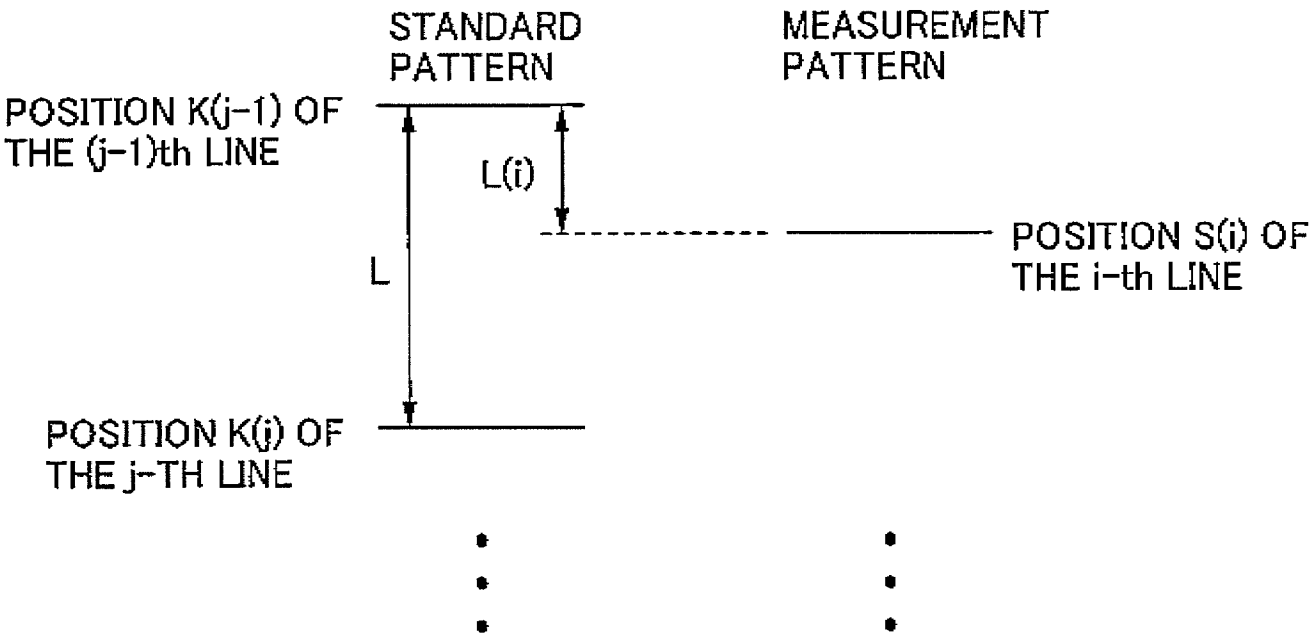
FIG. 24 is an explanatory diagram of calculating absolute positions of an i-th line in the measurement pattern.

FIG. 24 is an explanatory diagram of calculating absolute positions of an (i-th) line in the measurement pattern. Here, the i-th line of the measurement pattern is positioned between the (j−1)-th line of the standard pattern and the j-th line of the standard pattern. In the following description, the position (scanner coordinate system) of the i-th line in the measurement pattern is referred to as "S(i)" and the position (scanner coordinate system) of the j-th line in the standard pattern is referred to as "K(j)". Furthermore, the interval (y direction interval) between the (j−1)-th line and the j-th line of the standard pattern is referred to as "L" and the interval (y direction interval) between the (j−1)-th line of the standard pattern and the i-th line of the measurement pattern is referred to as "L(i)".

First, the computer 110 calculates a ratio H of the interval L(i) to the interval L based on the following expression;

$$H=L(i)/L$$

$$=\{S(i)-K(j-1)\}/\{K(j)-K(j-1)\}$$

Incidentally, the standard pattern on the actual standard sheet SS has uniform intervals, and therefore when the absolute position of the first line of the standard pattern is set to zero, the position of an arbitrary line in the standard pattern can be calculated. For example, the absolute position of the second line in the standard pattern is 1/36 inch. Accordingly, when the absolute position of the j-th line in the standard pattern is given as "J(j)" and the absolute position of the i-th line in the measurement pattern is given as "R(i)," R(i) can be calculated as shown in the following expression:

$$R(i)=\{J(j)-J(j-1)\}\times H+J(j-1)$$

The following is a description of a specific procedure for calculating the absolute position of the first line of the measurement pattern in FIG. 23. First, based on the value (373.768667) of S(1), the computer 110 detects that the first line of the measurement pattern is positioned between the second line and the third line of the standard pattern. Next, the computer 110 calculates that the ratio H is 0.40143008 (=(373.7686667−309.613250)/(469.430413−309.613250).

Next, the computer 110 calculates that an absolute position R(1) of the first line of the measurement pattern is 0.98878678 mm (=0.038928613 inches={1/36 inch}×0.40143008+1/36 inch).

In this manner, the computer 110 calculates the absolute positions of the lines in the measurement pattern.

Calculating Correction Values (S138)

Next, the computer 110 calculates correction values corresponding to multiple transport operations carried out when the measurement pattern is formed (S138). Each of the correction values is calculated based on a difference between a theoretical line interval and an actual line interval.

The correction value C(i) of the transport operation carried out between the pass i and the pass (i+1) is a value in which "R(i+1)−R(i)" (the actual interval between the absolute position of the line L(i+1) and the line Li) is subtracted from "6.35 mm" (¼ inch, that is, the theoretical interval between the line Li and the line L(i+1)). For example, the correction value C(1) of the transport operation carried out between the pass 1 and the pass 2 is 6.35 mm−{R(2)−R(1)}. The computer 110 calculates the correction value C(1) to the correction value C(21) in this manner.

Figure 25:
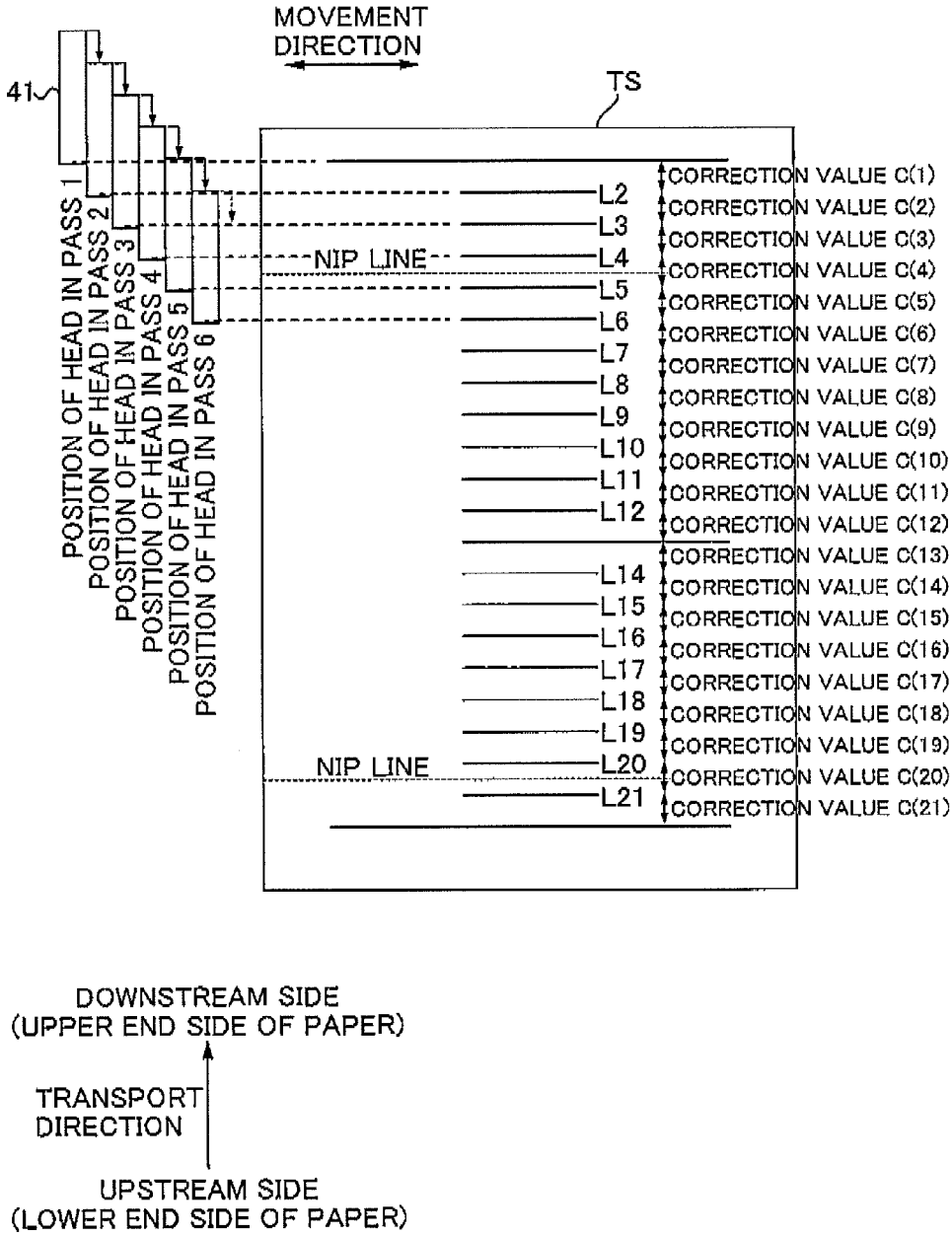
FIG. 25 is an explanatory diagram of a range corresponding to correction values C(i)

FIG. 25 is an explanatory diagram of a range corresponding to the correction values C(i). Supposing that a value obtained by subtracting the correction value C(1) from the initial target transport amount is set as the target in the transport operation between the pass 1 and the pass 2 when printing the measurement pattern, then the actual transport amount should become precisely ¼ inch (=6.35 mm).

Averaging Correction Values (S139)

The rotary encoder 52 of the present embodiment is not provided with an origin sensor, and therefore although the controller 60 can detect the rotation amount of the transport roller 23, it does not detect the rotation position of the transport roller 23. For this reason, the printer 1 cannot guarantee the rotation position of the transport roller 23 at the commencement of transport. That is, each time printing is carried out, there is a risk that the rotation position of the transport roller 23 is different at the commencement of transport. On the other hand, the interval between two adjacent lines in the measurement pattern is affected not only by the DC component transport error when transported by ¼ inch, but is also affected by the AC component transport error.

Consequently, if the correction value C that is calculated based on the interval between two adjacent lines in the measurement pattern is applied as it is when correcting the target transport amount, there is a risk that the transport amount will not be corrected properly due to the influence of the AC component transport error. For example, even when carrying out a transport operation by the ¼ inch transport amount between the pass 1 and the pass 2 in the same manner as when printing the measurement pattern, if the rotation position of the transport roller 23 at the commencement of transport is different to that at the time of printing the measurement pattern, then the transport amount will not be corrected properly even though the target transport amount is corrected with the correction value C(1). If the rotation position of the transport roller 23 at the commencement of transport is 180° different compared to the time of printing the measurement pattern, then due to the influence of the AC component transport error, not only will the transport amount not be corrected properly, it is possible that the transport error will actually be worsened Accordingly, in the present embodiment, in order to correct only the DC component transport error, a correction amount Ca for correcting the DC component transport error is calculated by averaging four correction values C as in the following expression;

$$Ca(i)=\{C(i-1)+C(i)+C(i+1)+C(i+2)\}/4$$

The following is a description of a reason for being able to calculate the correction values Ca for correcting DC component transport error by the above expression.

As stated earlier, the correction value C(i) of the transport operation carried out between the pass i and the pass (i+1) is a value in which "R(i+1)−R(i)" (the actual interval between the absolute position of the line L(i+1) and the line Li) is subtracted from "6.35 mm" (¼ inch, that is, the theoretical interval between the line Li and the line L(i+1)). By doing this, the above expression for calculating the correction values Ca possesses a meaning as in the following expression:

$$Ca(i)=[25.4\text{ mm}-\{R(i+3)-R(i-1)\}]/4$$

That is, the correction value Ca(i) is a value in which a difference between an interval of two lines that should be separated by one inch in theory (the line L(i+3) and the line L(i−1)) and one inch (the transport amount of a full rotation of the transport roller 23) is divided by four. In other words, the correction value Ca(i) is a value corresponding to the interval between a line L(i−1) and a line L(i+3), which is formed after one inch of transport has been performed after the forming of the line L(i−1).

Therefore, the correction values Ca(i) calculated by averaging four correction values C are not affected by the AC component transport error and are values that reflect the DC component transport error.

It should be noted that the correction value Ca(2) of the transport operation carried out between the pass 2 and the pass 3 is calculated to be a value obtained by dividing a sum total of the correction values C(1) to C(4) by four (an average value of the correction values C(1) to C(4)). In other words, the correction value Ca(2) is a value corresponding to the interval between the line L1 formed in the pass 1 and the line L5 formed in the pass 5 after one inch of transport has been performed after the forming of the line L1.

Furthermore, when i−1 becomes zero or less in calculating the correction values Ca(i), C(1) is applied for the correction value C(i−1). For example, the correction value Ca(1) of the transport operation carried out between the pass 1 and the pass 2 is calculated as {C(1)+C(1)+C(2)+C(3)}/4. Furthermore, when i+1 becomes 22 or more in calculating the correction values Ca(i), C(21) is applied for C(i+1) for calculating the correction value Ca. Similarly, when i+2 becomes 22 or more, C(21) is applied for C(i+2). For example, the correction value Ca(21) of the transport operation carried out between the pass 21 and the pass 22 is calculated as {C(20)+C(21)+C(21)+C(21)}/4.

The computer 110 calculates the correction values Ca(1) to Ca(21) in this manner. Through this, the correction values for correcting DC component transport error are obtained for each ¼ inch range.

Storing Correction Values (S116)

Next, the computer 110 stores the correction values in the memory 63 of the printer 1 (S104).

Figures 26, 27A:
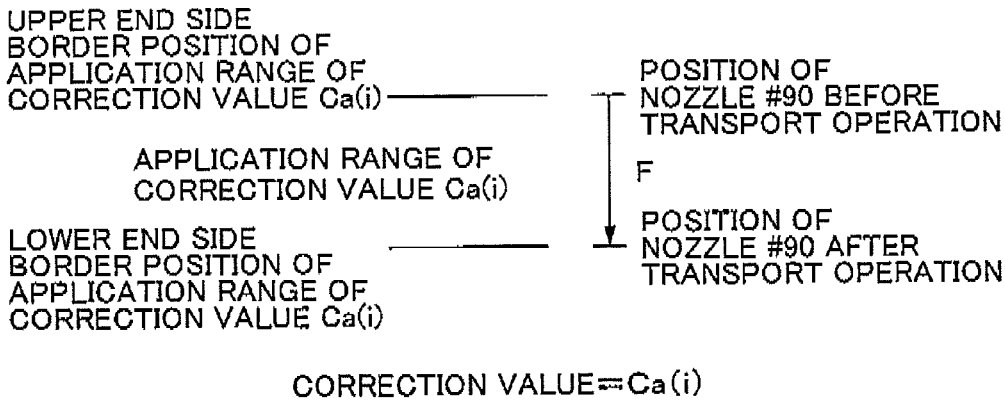
FIG. 26 is an explanatory diagram of a table stored in a memory 63.
FIG. 27A is an explanatory diagram of correction values in a first case.

FIG. 26 is an explanatory diagram of a table stored in the memory 63. The correction values stored in the memory 63 are correction values Ca(1) to Ca(21). Furthermore, border position information for indicating the range in which each correction value is applied is also associated with each correction value and stored in the memory 63.

The border position information associated with the correction values Ca(i) is information that indicates a position (theoretical position) corresponding to the lines L (i+1) in the measurement pattern, and this border position information indicates a lower end side border of the range in which the correction values Ca(i) are applied. It should be noted that the upper end side border can be obtained from the border position information associated with the correction values Ca(i−1). Consequently, the applicable range of the correction value C(2) for example is a range between the position of the line L1 and the position of the line L2 with respect to the paper S (at which nozzle #90 is positioned).

It should be noted that the correction value Ca obtained as described above is referred to as a first correction value Ca in order to distinguish this from a second correction value described later. The computer 110 transmits the first correction values Ca(i) obtained to the printer and causes a table of the first correction values Ca(i) to be stored in the memory 63 of the printer 1. In the next process, the printer 1 corrects the target transport amount by applying the first correction values.

Printing of Measurement Pattern Using First Correction Values (S106)

Here, the measurement pattern is printed using the first correction values obtained before. The printing carried out here is similar to the printing of the measurement pattern in S102 described above in terms of printing a measurement pattern, but differs in that transport is performed by correcting the target transport amount with the first correction values. Therefore, the following describes how the paper S is transported by using the first correction values, which is different from S102 described above, and description of printing of the measurement pattern is omitted.

When the paper S is transported using the first correction values during printing, the controller 60 reads out the table from the memory 63 and corrects the target transport amount based on the correction values, and performs transport operation based on the corrected target transport amount.

FIG. 27A is an explanatory diagram of correction values in a first case. In the first case, the position of the nozzle #90 before the transport operation (the relative position with respect to the paper) matches the upper end side border position of the applicable range of the correction values Ca(i), and the position of the nozzle #90 after the transport operation matches the lower end side border position of the applicable range of the correction values Ca(i). In this case, the controller 60 sets the correction values to Ca(i), sets as a target a value obtained by adding the correction values Ca(i) to an initial target transport amount F, then drives the transport motor 22 to transport the paper.

Figure 27B:
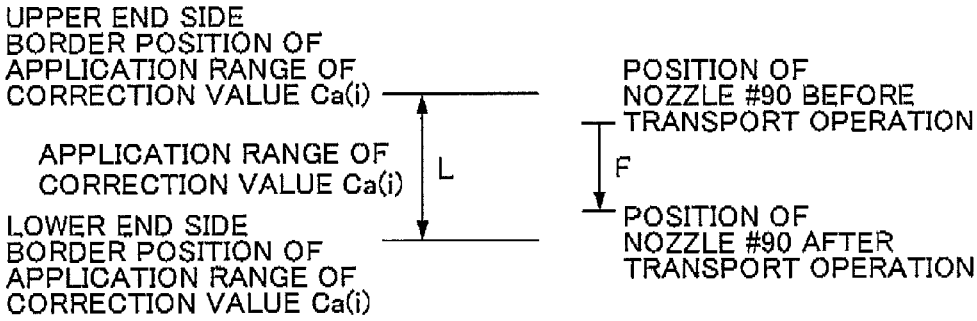
FIG. 27B is an explanatory diagram of correction values in a second case.

FIG. 27B is an explanatory diagram of correction values in a second case. In the second case, the positions of the nozzle #90 before and after the transport operation are both within the applicable range of the correction values Ca(i). In this case, the controller 60 sets as a correction value a value obtained by multiplying a ratio F/L between the initial target transport amount F and a transport direction length L of the applicable range by Ca(i). Then, the controller 60 sets as a target a value obtained by adding the correction values Ca(i) multiplied by (F/L) to the initial target transport amount F, then drives the transport motor 22 to transport the paper.

Figure 27C:
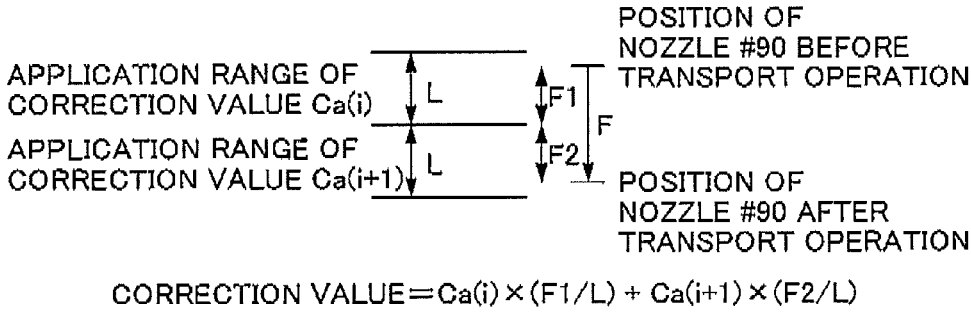
FIG. 27C is an explanatory diagram of correction values in a third case.

FIG. 27C is an explanatory diagram of correction values in a third case. In the third case, the position of the nozzle #90 before the transport operation is within the applicable range of the correction values Ca(i), and the position of the nozzle #90 after the transport operation is within the applicable range of the correction values Ca(i+1). Here, of the target transport amounts F, the transport amount in the applicable range of the correction values Ca(i) is set as F1, and the transport amount in the applicable range of the correction values Ca(i+1) is set as F2. In this case, the controller 60 sets as the correction value a sum of a value obtained by multiplying Ca(i) by F1/L and a value obtained by multiplying Ca(i+1) by F2/L. Then, the controller 60 sets as a target a value obtained by adding the correction value to the initial target transport amount F, then drives the transport motor 22 to transport the paper.

Figure 27D:
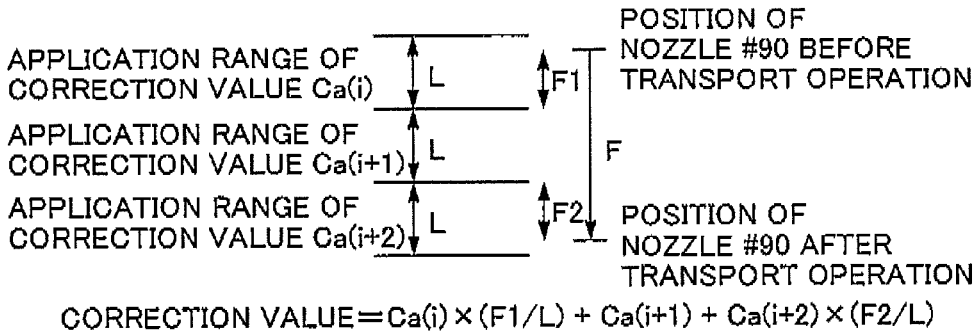
FIG. 27D is an explanatory diagram of correction values in a fourth case.

FIG. 27D is an explanatory diagram of correction values in a fourth case. In the fourth case, the paper is transported so as to pass the applicable range of the correction values Ca(i+1). In this case, the controller 60 sets as the correction value a sum of a value obtained by multiplying Ca(i) by F1/L, Ca(i+1) and a value obtained by multiplying Ca(i+2) by F2/L. Then, the controller 60 sets as a target a value obtained by adding the correction value to the initial target transport amount F, then drives the transport motor 22 to transport the paper.

In this way, when the controller corrects the initial target transport amount F and controls the transport unit based on the corrected target transport amount, the actual transport amount is corrected so as to become the initial target transport amount F, and the DC component transport error is corrected.

Incidentally, in calculating the correction values as described above, when the target transport amount F is small, the correction value will also be small. If the target transport amount F is small, it is conceivable that the transport error produced when carrying out the transport will also be small, and therefore by calculating the correction values in the above manner, correction values that match the transport error produced during transport can be calculated. Furthermore, an applicable range is set for each ¼ inch with respect to the correction value Ca, and therefore this makes it possible to accurately correct the DC component transport error, which fluctuates depending on the relative position of the paper S and the head 41.

It should be noted that in the printing of the measurement pattern using the first correction values, the measurement pattern is printed using the first case during transport of the paper.

In this manner, the paper is transported with the target transport amount being corrected using the first correction values Ca(i), and the lines L1 to L22 and the identifying code are printed.

Second Correction Value Determining Process (S108)

Figures 28, 29:
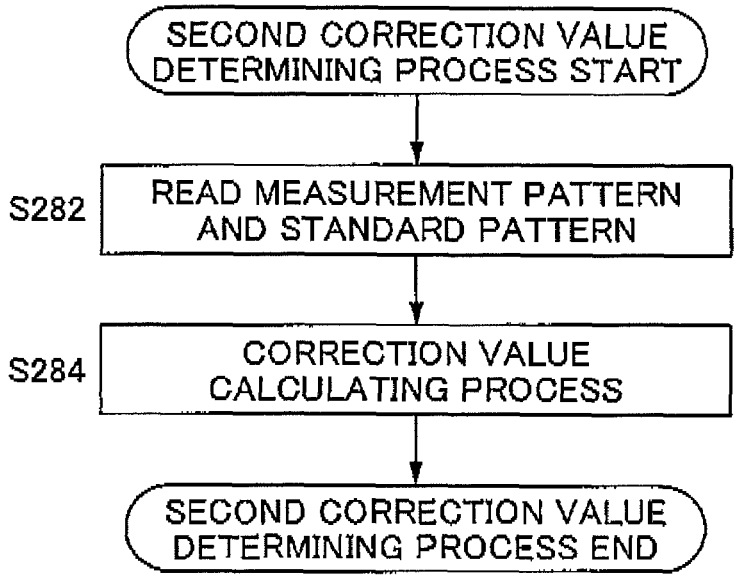
FIG. 28 is a flowchart for describing a second correction value determining process.
FIG. 29 is a diagram showing a second correction value table.

FIG. 28 is a flowchart for describing a second correction value determining process. In the second correction value determining process, a process substantially the same as the first correction value determining process described above is carried out. These processes differ in that the second correction value determining process does not include the process in S116 in FIG. 13 (storing correction values).

In the second correction value determining process, firstly the measurement pattern and the standard pattern are read (S282). This process is similar to the process in S112 in FIG. 13 and therefore is not described here. By carrying out this process, a measurement pattern (second pattern) which has been printed applying the first correction values is read.

Next, in the second correction value determining process, a correction value calculating process (S284) is carried out. This process is similar to the correction value calculating process in FIG. 13 and therefore is not described here. By carrying out this process, correction values C'(i) can be obtained based on the measurement pattern, which has been printed applying the first correction values (second pattern). And by averaging four correction values C', the second correction values Ca'(i) are obtained. The range corresponding to each correction value C'(i) is as shown in FIG. 25, in which the correction value C(i) is replaced by C'(i).

The second correction values are obtained for the following reason. That is, a slight transport error may be produced even if the transport amount is corrected by applying the first correction values. The second correction values are obtained based on the standard pattern which has been subjected to the transport amount correction using the first correction values, and therefore are for correcting slight transport errors that have not been eliminated by applying the first correction values. Accordingly, by using the second correction values obtained here in addition to the first correction values in correcting the transport amount, transport can be carried out more precisely than in the case where the transport amount is corrected using the first correction values only. As a result, if the first correction value is a correct correction value, the second correction value would be "0".

FIG. 29 is a diagram showing a table of second correction values. By executing the above-described second correction value determining process, a second correction value table as shown in FIG. 29 is created. This created second correction value table is stored in a memory of the computer 110. At this time, the border position information is also stored in association with the correction values.

Final Correction Value Determining Process (S110)

Next, a final correction value determining process is described.

In this case, paper of 4×6 size is used. The upper end side NIP line is present between the line L4 and the line L5. That is, during the transport carried out after the line L4 has been printed and before printing the line L5 starts, the upper end of the paper reaches the toothed rollers 27. Also, the lower end side NIP line is present between the line L20 and the line L21. That is, during the transport carried out after the line L20 has been printed and before printing the line L21 starts, the lower end of the paper ceases to be secured by the transport roller. Specifically, times at which the paper is not steadily transported are present during the transport carried out after the line L4 has been printed and before printing the line L5 starts, as well as the transport after the line L20 has been printed and before printing the line L21 starts. On the other hand, at any times other than those, the paper is steadily transported. These positions of NIP lines corresponding to various paper sizes are pre-stored in the memory of the computer 110.

Since the paper reaches the toothed rollers 27 during transport carried out after the line L4 has been printed and before printing the line L5 starts, during that transport, there are cases where the paper is not transported steadily. Therefore, the transport amount between the line L4 and the line L5 varies each time. Therefore, correcting the transport amount by applying the first correction values cannot eliminate inconsistent transport errors that show different amounts each time. As a result, the correction value C'(4) obtained based on the transport errors that could not have been eliminated has an absolute value larger than other correction values.

FIG. 30 is a diagram showing absolute values of the second correction values for the relative position of the paper and the head. In FIG. 30, the horizontal axis indicates the number assigned to each second correction value Ca'. The vertical line indicates the second correction values Ca'. The second correction values Ca'are each obtained by averaging four correction values Ca'. Therefore, the correction value C'(4) obtained based on the interval between the line L4 and the line L5 has an influence on the second correction values Ca'(2) to Ca'(5). Therefore, as shown in FIG. 30, the absolute value of the second correction values Ca'(2) to Ca'(5) are larger than the absolute value of the other second correction values.

The same is applicable to the transport carried out after the line L20 has been printed and before printing the line L21 starts. As described above, the lower end of the paper ceases to be secured by the transport roller during the transport carried out after the line L20 has been printed and before printing the line L21 starts, as described above. That is, the correction value C(20)' has a larger absolute value than the other correction values C'. Accordingly, for the same reason as that described above, the absolute values of the second correction values Ca'(18) to Ca'(21) are larger than that of the other second correction values.

In view of the conditions described above, the first correction values and the second correction values for when i=2 . . . 5 and 18 . . . 21 (correction values affected by the unsteady transfer) are obtained based on the transport amounts containing the transport error that has not been removed, and therefore it is considered that the transport amount cannot be appropriately corrected simply by applying the second correction values in addition to the first correction values.

On the other hand, when FIG. 30 is referred to, the absolute value of the second correction values other than when i=2 . . . 5 and 18 . . . 21 is smaller than other second correction values. This is due to generation of a small amount of transport error, which cannot be removed even it the first correction values Ca are applied. As regards such portions, the correction error that could not be eliminated can be eliminated by correcting the transport amount by applying the second correction values in addition to the first correction values.

According to the above discussion, it is conceivable that better final correction value can be obtained by using different methods in obtaining final correction values when i=2 . . . 5 and 18 . . . 21, and in any other cases. Next, a method for calculating the final correction values Ca"(i) is described.

<When i=1, 6 . . . 17>

Here, the second correction values are for eliminating the transport error that could not be eliminated even by applying the first correction values. Therefore, the final correction values are obtained as the sums of the first correction values and the second correction values, so as to simultaneously apply both values. That is, the final correction values Ca"(i) are obtained as follows:

$$Ca''(i)=Ca(i)+Ca'(i)$$

When it is possible to eliminate most of the transport error with only the first correction values Ca(i), the second correction values may be set such that Ca'(i)=0.

<When i=2 . . . 5, 18 . . . 21>

The amount of transport between lines during transport in which paper reaches the discharge roller and ceases to be secured by the transport roller, varies each time. This is because each time a different amount of transport error is contained in the transport amount. As a transport amount correction to cope with such a case, it is preferable to perform a transport amount correction that works on the entire transport errors to some extent, by using final correction values for correcting an average transport error of the errors that vary each time.

When the correction value is obtained based on the generated transport amount that varies each time, the correction value itself varies each time. Accordingly, the final correction values for correcting an average transport error cannot be obtained simply by adding the obtained first correction value and second correction value (if the final correction value is obtained simply by adding the obtained first and second correction values, such a final correction value eliminates the transport error contained in the transport amount used in obtaining the second correction value).

Therefore, in this case, by averaging the correction values obtained based on such varying transport errors, the final correction values Ca"(i) that eliminate an average transport error are obtained.

Here, a median value (average value) of a first correction value Ca(i) and the sum of the first correction value Ca(i) and a second correction value Ca'(i) is employed as a final correction value Ca"(i). Therefore, the final correction values Ca"(i) (when i=2 . . . 5, 18 . . . 21) can be obtained as follows:

$$Ca''(i) = [Ca(i) + \{Ca(i) + Ca'(i)\}]/2 \quad \text{(Expression 1)}$$
$$= Ca(i) + Ca'(i)/2$$

FIG. 31 is an explanatory diagram of a table of correction values (final) obtained by the final correction value determining process. The sums of the first correction values Ca(i) and the second correction values Ca'(i) are respectively assigned to the final correction values Ca"(i) other than when i=2 . . . 5, 18 . . . 21.

On the other hand, Expression 1 is applied for obtaining the final correction values Ca"(i) when i=2 . . . 5, 18 . . . 21, and the median value of a first correction value Ca(i) and the sum of the first correction value Ca(i) and a second correction value Ca'(i) is set as the correction value.

Next, the computer 110 stores the correction values (final) in the memory 63 of the printer 1. The table of correction illustrated in FIG. 30 is stored. The border position information for indicating the range where each correction value is applied is also stored in the memory 63 associated with each correction value.

In this manner, at the printer manufacturing plant, in each manufactured printer, a table that reflects characteristics of individual printers is stored in the memory 63. Then, the printer with such a table stored therein is delivered to the user.

Through this, even when the transport amount is corrected for unsteady transport, a favorable transport amount correction can be performed by applying correction values taking into account the inconsistent transport error.

Incidentally, when the final correction values Ca"(i) (i=2 . . . 5, 18 . . . 21) are obtained, it is also possible to employ a value that is present between a first correction value Ca(i) and the sum of the first correction value Ca(i) and a second correction value Ca'(i). In such a case, the final correction values Ca"(i) are obtained as follows:

$$Ca''(i) \approx Ca(i) + h \cdot Ca'(i)$$

$(0<h<1)$

Through this, even when the transport amount is corrected for unsteady transport, a favorable transport amount correction can be performed by applying correction values that are obtained by taking into account the inconsistent transport errors.

Other Embodiments

The foregoing embodiments described primarily a printer. However, it goes without saying that the foregoing description also includes the disclosure of printing apparatuses, recording apparatuses, liquid ejection apparatuses, transport methods, printing methods, recording methods, liquid ejection methods, printing systems, recording systems, computer systems, programs, storage media having a program stored thereon, display screens, screen display methods, and methods for producing printed material, for example.

Also, a printer, for example, serving as an embodiment was described above. However, the foregoing embodiment is for the purpose of elucidating the present invention and is not to be interpreted as limiting the present invention. The invention can of course be altered and improved without departing from the gist thereof and includes functional equivalents. In particular, embodiments described below are also included in the invention.

Regarding the Printer

In the above embodiments a printer was described, however, there is no limitation to this. For example, technology like that of the present embodiments can also be adopted for various types of recording apparatuses that use inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly polymer EL manufacturing devices), display manufacturing devices, film formation devices, and DNA chip manufacturing devices.

Furthermore, there is no limitation to the use of piezo elements and, for example, application in thermal printers or the like is also possible. Furthermore, there is no limitation to ejecting liquids and application in wire dot printers or the like is also possible.

Summary (1) In the present embodiment, paper is transported in the transport direction with respect to the head according to the target transport mount that is targeted, and the measurement pattern (first pattern) for confirming the transport amount of the paper is recorded by the head (S102). Next, the first correction values Ca(i), which are for correcting the target transport amount during transport of the paper and are associated with the relative position of the head and the paper, are obtained (S104, first correction value determining process) based on the measurement pattern (first pattern).

Next, the paper is transferred with the target transport amount corrected using the first correction values corresponding to the relative position, and the measurement pattern (second pattern) for confirming the transport amount of the paper is recorded by the head (S106). Then, the second correction values, which are for correcting the target transport amount during transport of the paper and are associated with the relative position of the head and the paper, are obtained based on the measurement pattern (second pattern).

The first correction values and second correction values associated with the relative position when the paper reaches the discharge roller (roller provided on the transport direction downstream side of the head) and those associated with the relative position other than when the paper reaches the discharge roller are used in a different manner, and the correction values (final values) of the target transport amount are determined (S110, final correction value determining process).

Through this, the first correction values and second correction values associated with the relative position when the paper reaches the discharge roller and those associated with the relative position other than when the paper reaches the discharge roller are used in a different manner, and correction values appropriate for the respective relative positions can be obtained.

(2) Also, when the correction values for the target transport amount is determined (S110), the sums of the first correction values and second correction values are used as the correction values (final values) for the target transport amount associated with the relative position other than when the paper reaches the discharge roller.

Through this, for the relative position other than when the paper reaches the discharge roller, it is possible to transport a medium while correcting the transport error using the sums of the first correction values and second correction values.

(3) When the correction values for the target transport amount are determined (S110), a value between a first correction value and the sum of the first correction value and a second correction value is used as the correction value (final value) for the target transport amount associated with the relative position when the paper reaches the discharge roller.

Through this, the correction values for the relative position that corresponds to when the paper reaches the discharge roller and those for the relative position that corresponds to times other than when the paper reaches the discharge roller are obtained by using different methods, so that the correction values appropriate for the respective relative positions can be obtained.

(4) When the correction values for the target transport amount are determined (S110), a median value of a first correction value and the sum of the first correction value and a second correction value is used as the correction value (final value) for the target transport amount associated with the relative position of paper when the paper reaches the discharge roller.

Through this, the correction values for the relative position that corresponds to when the paper reaches the discharge roller and those for the relative position that corresponds to other than when the paper reaches the discharge roller are obtained by using different methods, so that the correction values appropriate for the respective relative positions can be obtained.

(5) The following is further included; when the correction values for the target transport amount are determined (S110), the first correction values and second correction values associated with the relative position when the paper ceases to be secured by the transport roller (roller provided on the transport direction upstream side of the head) and those associated with the relative position other than when the paper ceases to be secured by the transport roller are used in a different manner, and the correction values of the target transport amount are determined.

Through this, the correction values for the relative position that corresponds to when the paper ceases to be secured by the transport roller and those for the relative position that corresponds to other than when the paper ceases to be secured by the transport roller are obtained by using different methods, so that the correction values appropriate for the respective relative positions can be obtained.

(6) Also, the respective positions of paper when the paper ceases to be secured by the transport roller and when the paper reaches the discharge roller are determined in advance based on the positional relation between the transport roller and the discharge roller.

(7) In addition, the first correction values and second correction values associated with the relative position when the paper ceases to be secured by the transport roller and those when the paper reaches the discharge roller are used in the same manner.

(8) Furthermore, a correction value determining apparatus such as that described below is of course possible; a correction value determining apparatus that includes a memory and a calculating section.

In a memory are stored the first correction values, which are for correcting the target transport amount when transporting paper based on the first pattern for confirming the transport amount of paper, and which are associated with the relative position of the head and the paper. Also, in this memory, the second correction values that are associated with the relative position of the head and the paper based on the second pattern, which is recorded while transporting paper based on the first correction values, and which is for confirming the transport amount of paper.

Furthermore, the calculating section determines correction values of the target transport amount by using in a different manner the first correction values and second correction values associated with the relative position when the paper reaches the discharge roller and those associated with the relative position other than when the paper reaches the discharge roller.

Through this, by using in a different manner the first correction values and second correction values associated with the relative position when the paper reaches the discharge roller and those associated with the relative position other than when the paper reaches the discharge roller, appropriate correction values for the respective relative positions can be obtained.

(9) Needless to say, a program for realizing the above-described correction value determining apparatus by causing the above-described methods to be executed by a computer is also possible.

What is claimed is:

1. A correction value determining method comprising:

causing a head to record a first pattern for confirming a transport amount of a medium, while transporting the medium in a transport direction relative to the head in accordance with a target transport amount;

obtaining a first correction value that is associated with a relative position of the head and the medium based on the first pattern, the first correction value being a correction value for correcting the target transport amount during transport of the medium;

causing the head to record a second pattern for confirming the transport amount of the medium, by transporting the medium while correcting the target transport amount using the first correction value associated with the relative position;

obtaining a second correction value that is associated with the relative position of the head and the medium based on the second pattern, the second correction value being a correction value for correcting the target transport amount during transport of the medium; and determining a correction value of the target transport amount by making a use of the first correction value and the second correction value associated with the relative position when the medium reaches a roller provided on a downstream side of the head in the transport direction different from a use of the first correction value and the second correction value associated with the relative position at times other than when the medium reaches the roller.

2. A correction value determining method according to claim 1, wherein determining the correction value for the target transport amount includes using a sum of the first correction value and the second correction value as the correction value for the target transport amount associated with the relative position at times other than when the medium reaches the roller.

3. A correction value determining method according to claim 1, wherein determining the correction value for the target transport amount includes using a value between the first correction value and the sum of the first correction value and the second correction value as the correction value for the target transport amount associated with the relative position when the medium reaches the roller.

4. A correction value determining method according to claim 3, wherein determining the correction value for the target transport amount includes using a median value of the first correction value and the sum of the first and second correction values, as the correction value for the target transport amount associated with the relative position when the medium reaches the roller.

5. A correction value determining method according to claim 1, wherein determining the correction value for the target transport amount further includes determining the correction value of the target transport amount by making a use of the first correction value and the second correction value associated with the relative position when the medium ceases to be secured by a roller provided on an upstream side of the head in the transport direction different from a use of the first correction value and the second correction value associated with the relative position at times other than when the medium ceases to be secured by the roller provided on the upstream side.

6. A correction value determining method according to claim 5, wherein the relative position when the medium ceases to be secured by the roller provided on the upstream side and the relative position when the medium reaches the roller provided on the downstream side are determined in advance depending on the positional relationship of the roller provided on the upstream side and the roller provided on the downstream side.

7. A correction value determining method according to claim 5, wherein the first correction value and the second correction value associated with the relative position are used in the same manner when the medium ceases to be secured by the roller provided on the upstream side and when the medium reaches the roller provided on the downstream side.

8. A correction value determining apparatus, comprising:

(A) a memory that stores a first correction value and a second correction value, the first correction value being associated with a relative position of a head and a medium, and being used to correct a target transport amount during transport of the medium based on a first pattern for confirming a transport amount of the medium, the second correction value being associated with the relative position of the head and the medium based on a second pattern for confirming the transport amount of the medium, the second pattern being a pattern recorded while the medium is transported based on the first correction value;

(B) a calculating section that determines a correction value of the target transport amount, by making a use of the first correction value and the second correction value associated with the relative position when the medium reaches a roller provided on the downstream side of the head in the transport direction different from a use of the first correction value and the second correction value associated with the relative position at times other than when the medium reaches the roller.

9. A storage medium with a program stored thereon, the program comprising:

a code for causing a head to record a first pattern for confirming a transport amount of a medium, while transporting the medium in a transport direction relative to the head in accordance with a target transport amount;

a code for obtaining a first correction value that is associated with a relative position of the head and the medium based on the first pattern, the first correction value being a correction value for correcting the target transport amount during transport of the medium;

a code for causing the head to record a second pattern for confirming the transport amount of the medium, by transporting the medium while correcting the target transport amount using the first correction value associated with the relative position;

a code for obtaining a second correction value that is associated with the relative position of the head and the medium based on the second pattern, the second correction value being a correction value for correcting the target transport amount during transport of the medium; and a code for correcting the target transport amount by a use of the first correction value and the second correction value associated with the relative position when the medium reaches a roller provided on the downstream side of the head in the transport direction that is different from a use of the first correction value and the second correction value associated with the relative position at times other than when the medium reaches the roller.

* * * * *